United States Patent [19]

Obata

[11] Patent Number: 5,014,589

[45] Date of Patent: May 14, 1991

[54] CONTROL APPARATUS FOR ELECTRONIC MUSICAL INSTRUMENT FOR GENERATING MUSICAL TONE HAVING TONE PITCH CORRESPONDING TO INPUT WAVEFORM SIGNAL

[75] Inventor: Katsuhiko Obata, Tachikawa, Japan

[73] Assignee: Casio Computer Co., Ltd., Tokyo, Japan

[21] Appl. No.: 329,418

[22] Filed: Mar. 27, 1989

[30] Foreign Application Priority Data

Mar. 31, 1988 [JP] Japan ..... 63-76492

[51] Int. Cl.[5] ..... G10H 1/06; G10H 1/18; G10H 1/46; G10H 3/18

[52] U.S. Cl. ..... 84/735; 84/741; 84/742

[58] Field of Search ..... 84/603-607, 84/616, 622-633, 654, 658-665, 681, 687-690, 692-711, 735-742, 454, DIG. 7, DIG. 9, DIG. 18

[56] References Cited

U.S. PATENT DOCUMENTS

| | | | |
|---|---|---|---|
| 4,117,757 | 10/1978 | Akamatu . | |
| 4,357,852 | 11/1982 | Suenaga | 84/454 X |
| 4,416,178 | 11/1983 | Ishida | 84/659 X |
| 4,606,255 | 8/1986 | Hayashi et al. . | |
| 4,633,748 | 1/1987 | Takashima et al. . | |
| 4,688,464 | 8/1987 | Gibson et al. . | |

FOREIGN PATENT DOCUMENTS

| | | |
|---|---|---|
| 55-55398 | 4/1980 | Japan . |
| 55-87196 | 7/1980 | Japan . |
| 55-152597 | 11/1980 | Japan . |
| 55-162132 | 11/1980 | Japan . |
| 55-159495 | 12/1980 | Japan . |
| 57-37074 | 8/1982 | Japan . |
| 57-58672 | 12/1982 | Japan . |
| 61-26090 | 2/1986 | Japan . |
| 61-51793 | 11/1986 | Japan . |
| 62-20871 | 5/1987 | Japan . |
| 62-163099 | 7/1987 | Japan . |

*Primary Examiner*—Stanley J. Witkowski

*Attorney, Agent, or Firm*—Frishauf, Holtz, Goodman & Woodward

[57] ABSTRACT

A pitch is extracted from an input waveform signal, and a musical tone having a corresponding tone pitch is generated. In this case, a signal intensity at the leading edge of the input waveform signal is detected to determine a tone volume of the musical tone. A change degree of the signal intensity at the leading edge of the input waveform signal is detected to determine a timbre of the musical tone. As a result, the tone volume and the timbre of the output musical tone can be independently controlled in accordance with a music performance manner, and an improvement of a performance effect is expected.

14 Claims, 21 Drawing Sheets

CONTROL APPARATUS FOR ELECTRONIC MUSICAL INSTRUMENT FOR GENERATING MUSICAL TONE HAVING TONE PITCH CORRESPONDING TO INPUT WAVEFORM SIGNAL

BACKGROUND OF THE INVENTION

1. Field of the Invention

The present invention relates to a control apparatus for an electronic musical instrument for generating a musical tone based on an input waveform signal.

2. Description of the Related Art

More specifically, the present invention relates to an electronic stringed instrument such as an electronic guitar, a guitar synthesizer, or the like, or other synthesizer type electronic musical instruments and, more particularly, to a control apparatus for an electronic musical instrument which changes the timbre of an output musical tone in accordance with a music performing manner.

Recently, various electronic musical instruments are known wherein a pitch (fundamental frequency) is extracted from an acoustic wave generated according to a human voice or the performance of a conventional musical instrument, and a sound source device comprising an electronic circuit is controlled to artificially produce an acoustic sound such as a musical note.

The following publications disclose such a technique:

(a) U.S. Pat. No. 4,117,757 (issued on Oct. 3, 1978), inventor: Akamatsu.

This patent discloses an electronic circuit for forming a waveform signal in which "1" and "0" sequentially are inverted at positive and negative peak points of and input waveform signal. This waveform signal is converted to a rectangular wave signal, and its frequency corresponds to a pitch of the input waveform signal.

(b) U.S. Pat. No. 4,606,255 (issued on Aug. 19, 1986), inventor: Hayashi et al.

This patent discloses a guitar synthesizer. A pitch is extracted for each string to obtain a corresponding voltage signal, and a musical tone signal is generated by voltage control.

(c) U.S. Pat. No. 4,644,748 (issued on Jan. 6, 1987), inventor: Takashima et al.

This patent discloses a technique for converting an acoustic signal input through a microphone into a digital signal, and extracting a pitch by digital processing.

(d) U.S. Pat. No. 4,688,464 (issued on Aug. 25, 1987), inventor: Gibson et al.

This patent discloses a technique for extracting a pitch in accordance with time intervals crossing three threshold levels, i.e., high, middle, and low threshold levels of an input waveform signal.

(e) Japanese Patent Publication No. 57-37074 (published on Aug. 7, 1982), applicant: Roland Kabushiki Kaisha.

(f) Japanese Patent Publication No. 57-58672 (published on Dec. 10, 1982), applicant: Roland Kabushiki Kaisha.

The contents of these two patents correspond to the above-mentioned patent (a), U.S. Pat. No. 4,117,757, and disclose techniques for generating a rectangular wave having a frequency corresponding to a pitch of an input waveform signal.

(g) Japanese Patent Disclosure (Kokai) No. 55-55398 (disclosed on Apr. 23, 1980), applicant: Toshiba Corp.

This patent application discloses a technique for generating a rectangular wave having a frequency corresponding to a pitch of an input waveform signal as in the patent (a), U.S. Pat. No. 4,117,757.

(h) Japanese Patent Disclosure (Kokai) No. 55-87196 (disclosed on July 1, 1980), applicant: Nippon Gakki Seizo Kabushiki Kaisha.

This prior-art invention discloses a technique for generating a fundamental wave pulse having a period corresponding to a pitch in accordance with an output from a pickup of a guitar, counting the pulse by an interval counter to obtain period data, and converting the period data into digital frequency data.

(i) Japanese Patent Disclosure (Kokai) No. 55-15949 (disclosed on Dec. 11, 1980), applicant: Nippon Gakki Seizo Kabushiki Kaisha.

This prior-art invention discloses a technique wherein when an extracted pitch is not varied, a musical tone is generated. When two adjacent periods substantially coincide with each other, a coincidence signal is generated, and tone generation is started in accordance with the coincidence signal.

(j) Japanese Utility Model Disclosure (Kokai) No. 55-152597 (disclosed on Nov. 4, 1980), applicant: Nippon Gakki Seizo Kabushiki Kaisha.

This prior-art device discloses a technique wherein a vibration of a string is extracted by an optical pickup, and the vibration of the string is excited by a picked-up signal to obtain a vibration sustain effect.

(k) Japanese Utility Model Disclosure (Kokai) No. 55-162132 (disclosed on Nov. 20, 1980), applicant: Keio Gikken Kougyo Kabushiki Kaisha.

This prior-art device discloses a technique wherein a detector detects a next zero-cross point of positive and negative peak points of an input waveform signal, and a flip-flop is set/reset in response to each point detection to generate a frequency signal corresponding to a pitch.

(l) Japanese Patent Publication No. 61-51793 (published on Nov. 10, 1986), applicant: Nippon Gakki Seizo Kabushiki Kaisha.

This patent is a publication of the invention (h) above, and has the same gist as the content of the invention (i) above. That is, digital frequency data is generated upon detection of a substantial coincidence between two adjacent periods.

(m) Japanese Utility Model Publication No. 62-20871 (published on May 27, 1987), applicant: Fuji Roland Kabushiki Kaisha.

This is a Japanese publication corresponding to the invention (b), U.S. Pat. No. 4,606,255.

(n) Japanese Patent Disclosure (Kokai) No. 61-26090 (disclosed on Feb. 5, 1986), applicant: Seikou Denshi Kougyo Kabushiki Kaisha.

This prior-art invention discloses a technique for detecting a pitch from an input waveform signal, sequentially writing the detected pitch in a memory, and obtaining accurate pitch data later by executing an arithmetic operation.

(o) Japanese Patent Disclosure (Kokai) No. 62-163099 (disclosed on July 18, 1987), applicant: Fuji Gen Gakki Seizo Kabushiki Kaisha.

This prior-art invention relates to a guitar controller for a guitar synthesizer, wherein frequency changing methods are switched in accordance with monophonic or polyphonic tones generated. More specifically, when a monophonic tone is generated, a picked-up vibration period is continuously reflected to determine the frequency of the musical sound to be generated. When a polyphonic tone is generated, the vibration period is reflected at chromatic scale steps to determine the same.

Furthermore, the following U.S. patent applications disclose an electronic stringed instrument and the associated electronic equipment are related to the present invention assigned: to the present assignee.

(p) U.S. Ser. No. 112,780 (filed on Oct. 22, 1987), inventor: Uchiyama et al.

This prior-art invention discloses a technique for measuring a time period between positive and negative peak points or between zero-cross points associated with these peak points to extract a pitch of an input waveform signal based on the measured time period, and a technique for performing various control operations in accordance with the obtained pitch.

(q) U.S. Ser. No. 184,099 (filed on Apr. 20, 1988), inventor: Iba et al.

In this prior-art invention, a musical tone parameter such as a timbre is designated by a fret operation and a picking operation of a string. In order to detect an operated fret, a pitch extraction technique, or a fret switch detection technique is used.

(r) U.S. Ser. No. 256,398 (filed on Oct. 7, 1988), inventor: Iba et al.

This prior-art invention discloses a technique for performing musical tone generation control in units of strings, changing characteristics of an output musical tone in accordance with the picking strength of a string, or controlling an effector or pan (sound localization).

(s) U.S. Ser. No. 252,914 (filed on Oct. 3, 1988), inventor: Uchiyama

In this prior-art invention, a pitch extraction circuit comprises a digital circuit in place of a conventional analog circuit, and integration of the electronic circuit can be facilitated.

(t) U.S. Ser. No. 256,400 (filed on Oct. 11, 1988), inventor: Matsumoto

This prior-art invention discloses an electronic apparatus for extracting a pitch from an input waveform signal and generating a musical tone having the corresponding tone pitch, and discloses a technique for changing a tone pitch of an output tone along with a change of the input waveform signal in pitch without accompanying an unnecessary variation in interval.

(u) U.S. Ser. No. 282,510 (filed on Dec. 9, 1988), inventor: Obata

In this prior-art invention, even if a pitch is unstably extracted at the beginning of tone generation, a musical tone having a stable pitch can be generated from the beginning. Start of musical tone generation is chromatically instructed on the basis of a pitch extracted by a pitch extraction system.

(v) U.S. Ser. No. 290,981 (filed on Dec. 28, 1988), inventor: Murata et al.

In this prior-art invention, strings are completely electronically tuned. Before a performance, a reference pitch is determined by plucking at a specific fret, and a tone pitch of a musical tone to be generated is determined on the basis of period data obtained by plucking at a designated fret using the reference pitch.

According to the prior art techniques described above, an intensity of an input waveform signal is detected at its leading edge, and a musical tone is generated while changing a tone volume and timbre of an output tone from a sound source.

Since the tone volume and timbre of a musical tone are changed using one parameter, that is, a signal intensity of the input waveform signal, if the input waveform signal is changed and a tone volume of a musical tone is increased, a timbre sounds hard. That is, these variables are always changed to have a correlation therebetween.

However, when an acoustic guitar or the like is actually plucked to directly produce a tone, even if a picking strength of a string is made constant to keep a constant one volume, a hard timbre is obtained upon picking near a bridge (fixing portion of strings) and a soft timbre is obtained upon picking near a fret (finger board).

Therefore, in the conventional electronic musical instrument wherein a tone volume and a timbre are changed by only a signal intensity, the tone volume and the timbre color cannot be independently controlled by shifting a string picking position. Thus, an abundant performance effect cannot be obtained.

SUMMARY OF THE INVENTION

The present invention has been made in consideration of the above situation, and has as its object to provide an electronic musical instrument which can independently control parameters such as tone volume, timbre, and the like of a musical tone according to an input waveform signal when a musical tone is generated.

According to the present invention, there is provided a control apparatus for an electronic musical instrument, comprising intensity detection means for detecting a signal intensity data at a leading edge of an input waveform signal, intensity change degree detection means for detecting a signal intensity change degree data at the leading edge of the input waveform signal, and musical tone generation control means for performing control such that at least two characteristics of a musical tone are changed in accordance with the signal intensity data and the signal intensity change degree.

More specifically, the electronic musical instrument is realized as an electronic stringed instrument (electronic guitar) for detecting a vibration of a metal string by a pickup and controlling a musical tone on the basis of the detected vibration although not limited to this.

The intensity detection means outputs a leading strength of an input waveform signal as a signal intensity data. In contrast to this, the intensity change degree detection means outputs a degree of change in intensity of an input waveform signal at its leading edge as a signal intensity change degree data.

As one arrangement of the intensity detection means, an average value of a maximum peak value, obtained in advance, of an input waveform signal at its leading edge and the next peak value having the same sign as the maximum peak value is calculated, and is output as a signal intensity parameter.

As one arrangement of the intensity change degree detection means, a ratio of the maximum peak value to the next peak value having the same sign a the maximum peak value is calculated, and is output as a signal intensity change degree parameter.

Therefore, if an intensity and a change degree of the intensity at the leading edge of the input waveform signal are independently changed in accordance with a performance method, the musical tone generation control means independently changes at least two characteristics of a musical tone, e.g., a tone volume and a timbre in accordance with the signal intensity and the signal intensity change degree, thus obtaining an abundant performance effect.

In particular, in an electronic stringed instrument, when a string picking position is shifted, only a signal intensity change degree can be changed while the signal intensity remains the same at the leading edge of the input waveform signal. Thus, only a timbre of a musical tone can be changed without changing its tone volume, and a great performance effect can be provided.

BRIEF DESCRIPTION OF THE DRAWINGS

The above and other objects and features of the present invention will be apparent from the description of the preferred embodiment taken in conjunction with the accompanying drawings, in which.

DETAILED DESCRIPTION OF THE PREFERRED EMBODIMENT

An embodiment of the present invention will now be described in detail.

In the following description, items are classified in the order of underlined captions enclosed in symbols {11}, (11), and <11>.

{Arrangement of Electronic Musical Instrument of the Present Invention}

This embodiment is realized as an electronic guitar, wherein six metal strings are kept taut on a body, and a desired string is picked while pressing a fret (finger board) arranged below the metal strings so as to make a performance. Note that its outer appearance will be omitted.

Figure 1:
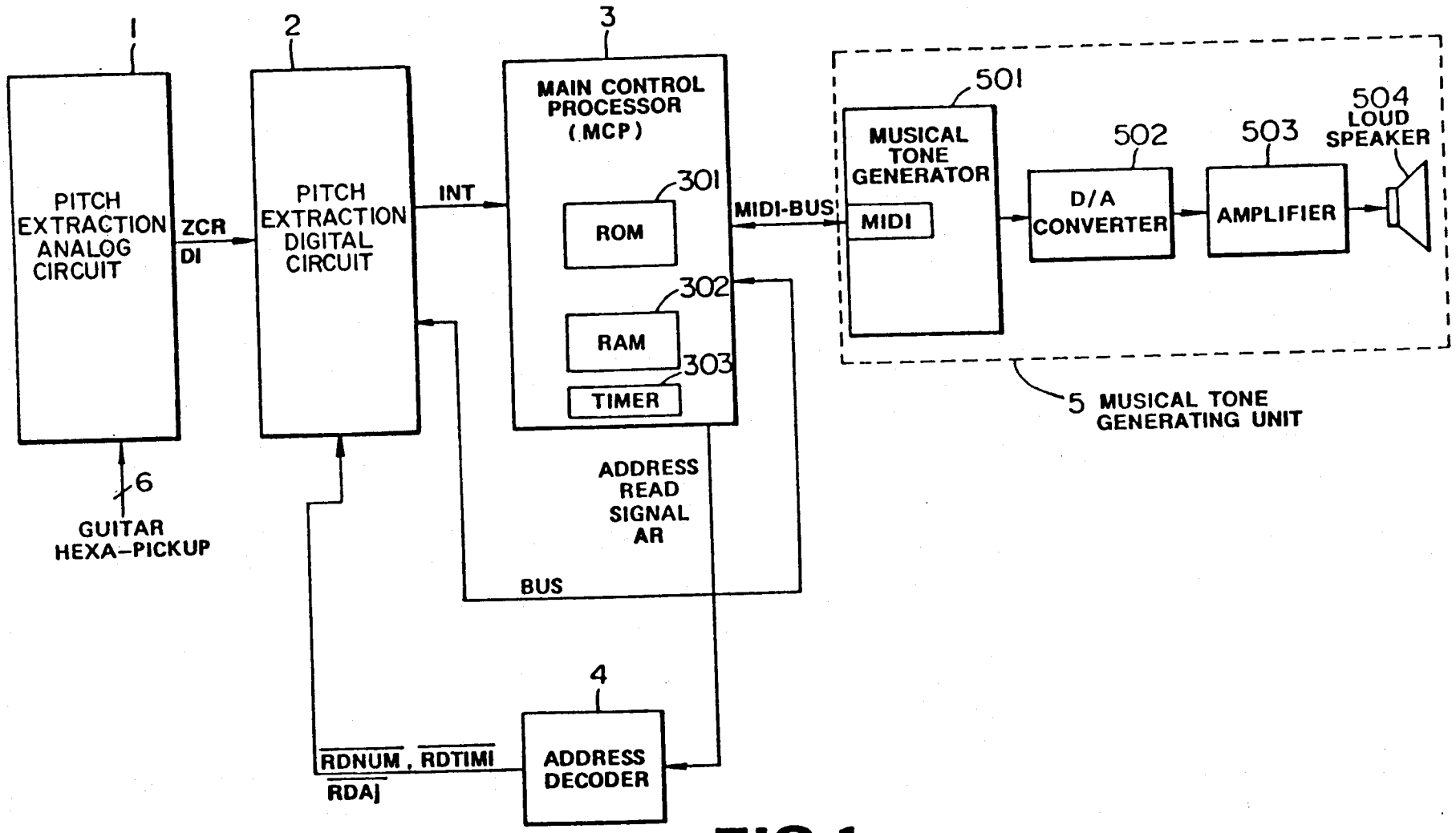
FIG. 1 is a block diagram showing the overall arrangement of an embodiment of the electronic musical instrument according to the present invention.

FIG. 1 is a block diagram showing the overall arrangement of this embodiment.

Pitch extraction analog circuit 1 is connected with the six strings (not shown). Hexa-pickups convert vibrations of the corresponding strings into electrical signals. These signals pass through low-pass filters (not shown) to remove a harmonic component thereof, thereby obtaining 6 waveform signals Wi (i=1 to 6). Furthermore, circuit 1 generates a zero-cross pulse signal Zi (i=1 to 6) which goes to H (High) or L (Low) level every time the sign of the amplitude of each waveform signal Wi is changed to positive or negative. These 6 waveform signals Wi are converted to a digital output (time-divisional waveform signal) D1 through corresponding A/D converters (not shown) or the like. These 6 zero-cross signals Zi are converted to a time-divisional serial zero cross signal ZCR. These digital signals are then output.

A pitch extraction digital circuit 2 comprises a peak detector 201, a time constant conversion controller 202, a peak value fetching circuit 203, and a zero-cross time fetching circuit 204. These circuits shown in FIG. 2 time-divisionally process data for the six strings on the basis of the time-divisional serial zero-cross signal ZCR and the digital output D1 corresponding to data of the six strings. In the following description, processing for one string will be described for the sake of easy understanding, and the serial zero-cross signal ZCR and the digital output D1 will be described as signals for one string. However, time-divisional processing for the six strings is performed unless otherwise specified.

Figure 2:
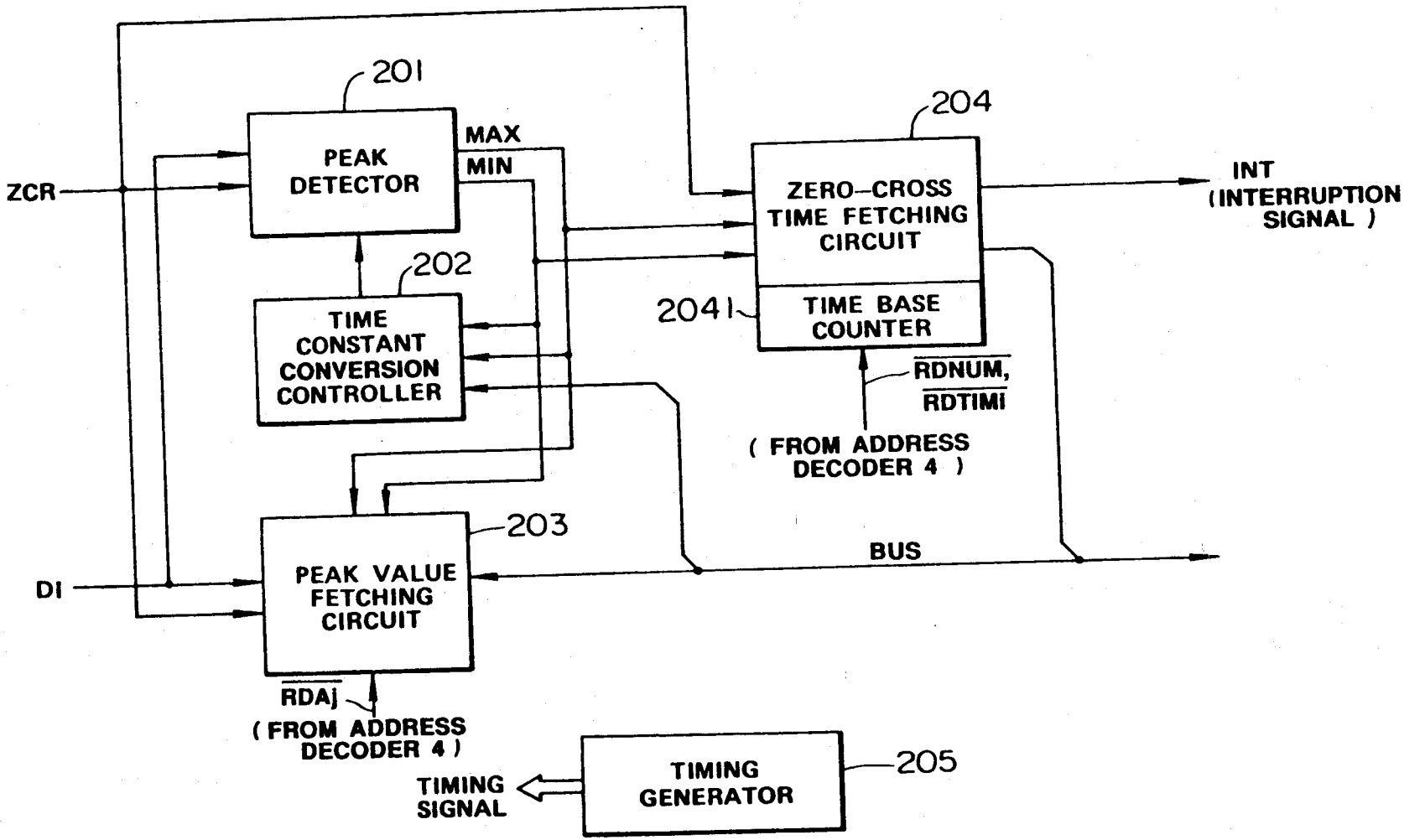
FIG. 2 is a block diagram of a pitch extraction digital circuit.

In FIG. 2, the peak detector 201 detects maximum and minimum peak points of the digital output D1 on the basis of the serial zero-cross signal ZCR and the digital output D1. Although not shown, the detector 201 includes a peak hold circuit for holding an absolute value of a previous peak value while subtracting (attenuating) it. The peak detector 201 detects the timing of a peak value by using a peak hold signal output from the peak hold circuit after the preceding detection of the peak value as a threshold value. That is, the peak detector 201 detects the timing when the absolute value of the digital output D1 exceeds the threshold value after the next serial zero-cross signal ZCR is generated. Note that timing detection of the peak value is executed for positive and negative signs of the digital output D1. At the detection timing of the peak value, the detector 201 outputs a maximum peak value detection signal MAX in the case of the positive sign, and outputs a minimum peak value detection signal MIN in the case of the negative sign. Note that these signals are time-divisional signals for the six strings, as a matter of course.

The time constant conversion controller 202 is a circuit for changing an attenuation factor of the peak hold circuit in the peak detector 201, and is operated in accordance with the maximum and minimum peak detection signal MAX and MIN under the control of a main control processor (to be referred to as an MCP hereinafter) 3 shown in FIG. 1. This operation will be described later.

The peak value fetching circuit 203 demultiplexes the digital output D1 time-divisionally sent from the peak extraction analog circuits 1 into peak values corresponding to the strings, and holds their peak values in accordance with the peak value detection signals MAX and MIN from the peak detector 201. The circuit 203 sequentially outputs to the MCP 3 through a bus BUS the maximum or minimum peak value for a string accessed by the MCP 3 (FIG. 1) through an address decoder 4 (FIG. 1). The peak value fetching circuit 203 can output an instantaneous value of a vibration of each string in addition to the peak values.

The zero-cross time fetching circuit 204 latches an output from a time-base counter 2041 common to the strings at a zero-cross timing of each string, strictly, at a zero-cross point immediately after a passage timing of the maximum and minimum peak determined by the maximum and minimum peak value detection signals MAX and MIN output from the peak detector 201 in accordance with the serial zero-cross signal ZCR from the pitch extraction analog circuits 1 (FIG. 1). When this latch operation is performed, the zero-cross time fetching circuit 204 outputs an interruption signal INT to the MCP 3 shown in FIG. 1. Thus, the circuit 204 sequentially outputs a number of string of which vibration has been past through a zero-cross point, the latched zero-cross time and positive/negative data corresponding to the string (to be described later) to the MCP 3 through the bus BUS in accordance with a control signal (to be described later) output from the MCP 3 through the address decoder 4 (FIG. 1).

A timing generator 205 shown in FIG. 2 outputs timing signals for processing operations of the circuits shown in FIGS. 1 and 2.

Referring again to FIG. 1, the MCP 3 has memories, e.g., a ROM 301 and a RAM 302, and also has a timer 303. The ROM 301 comprises a nonvolatile memory for storing various musical tone control programs (to be described later), and the RAM 302 comprises a programmable memory used as a work area for various variables and data during a control operation. The timer 303 is used for note-off (muting) processing (to be described later).

A musical tone generating unit 5 comprises a musical tone generator 501, an A/D converter 502, an amplifier 503, and a loudspeaker 504, and produces a musical tone corresponding to musical tone control data from the MCP 3. Note that an interface (Musical Instrument Digital Interface) MIDI is arranged at the input side of the musical tone generator 501, and is connected to the MCP 3 through a special-purpose bus MIDI-BUS for transmitting musical tone control data. When the musical tone generating unit 5 is arranged in the guitar body, another internal interface can be arranged between the unit 5 and the MCP 3.

The address decoder 4 shown in FIG. 1 supplies a string number read signal $\overline{\text{RDNUM}}$ and then a time read signal $\overline{\text{RDTIMi}}$ (i=1 to 6) to the zero-cross time fetching circuit 204 in accordance with an address read signal AR generated by the MCP 3 (FIG. 1) after the interruption signal INT is generated by the zero-cross time fetching circuit 204 (FIG. 2). Similarly, the decoder 4 outputs a waveform read signal RDAj (j=1 to 18) to the peak value fetching circuit 203 (FIG. 2). These operations will be described later in detail.

{General Operation of This Embodiment}

The operation of the embodiment with the above arrangement will now be described.

A general operation of this embodiment will be described first.

Figure 10:
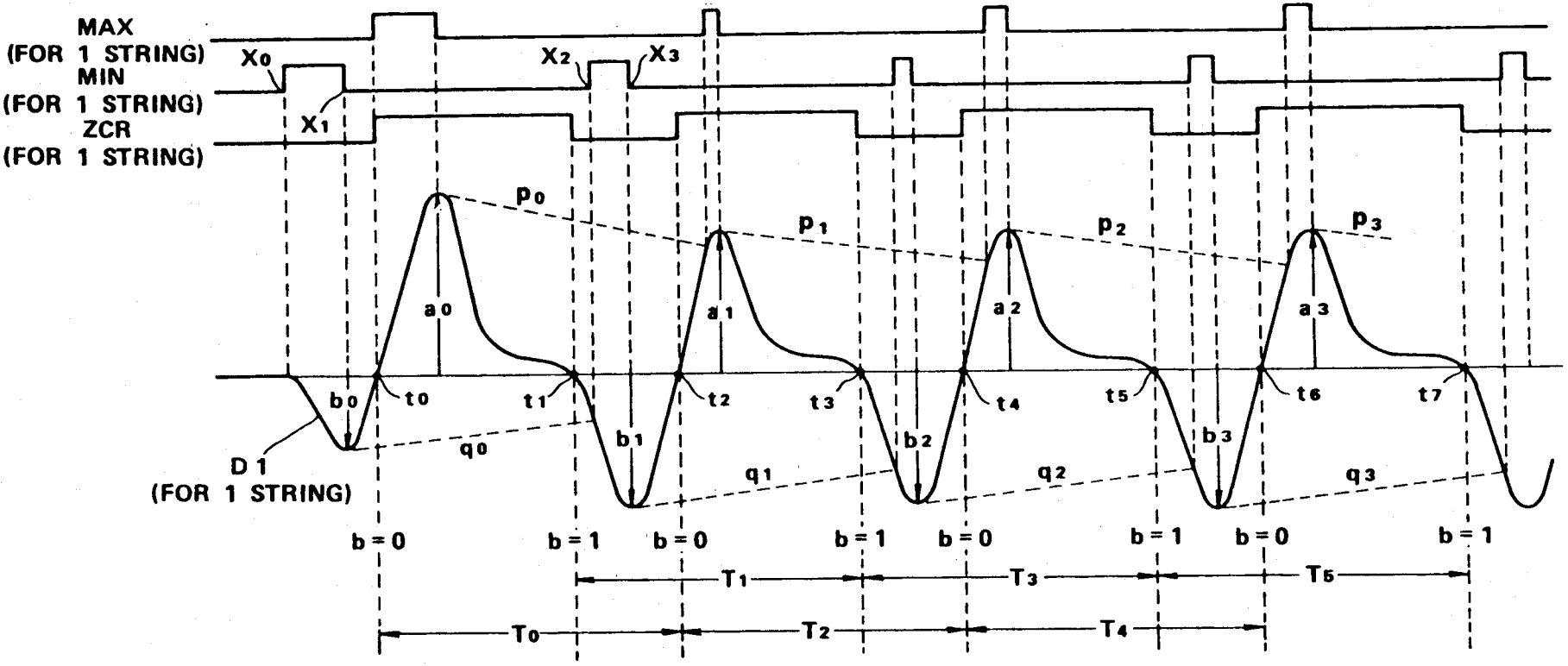
FIG. 10 is a chart for explaining a schematic operation of this embodiment.

A waveform D1 in FIG. 10 represents the digital output D1 for one string output from the pitch extraction analog circuit 1 shown in FIG. 1 in an analog manner. This output waveform signal is a digital signal, which is obtained from an electrical signal detected by the corresponding pickup when one of the six strings of the guitar (not shown) is plucked The waveform signal has pitch periods indicated by $T_0$ to $T_5$ in FIG. 10 in accordance with a position where the string is pressed on a fret (finger board) (not shown).

In this embodiment, the pitch periods $T_0$ to $T_5$ are extracted in real time, so that the MCP 3 generates corresponding tone pitch data and causes the musical tone generator 501 shown in FIG. 1 to generate a musical tone having the tone pitch. Therefore, when a player changes a tension of the string using a tremolo arm (not shown), the pitch period of the digital output D1 is changed accordingly, and tone pitch data is also changed accordingly. As a result, an abundant expression can be added to a musical tone.

In this embodiment, peak values $a_0$ to $a_3$ or $b_0$ to $b_3$ of the digital output D1 shown in FIG. 10 are detected, and a tone volume and a timbre of a musical tone can be controlled based on the peak values $a_0$ and $a_1$ at the leading edge (upon plucking of a string).

More specifically, the MCP 3 shown in FIG. 1 calculates an average value of the peak values $a_0$ and $a_1$, and transfers the average value as tone volume data to the musical tone generator 501. Thus, a musical tone having a tone volume corresponding to a string plucking strength can be generated.

Figure 11A:
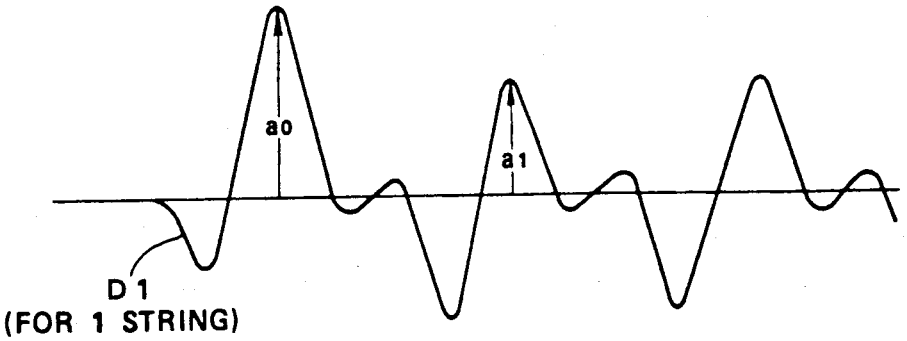
FIGS. 11A and 11B are waveform charts for explaining an operation for determining a tone volume and a timbre of this embodiment.
Figure 11B:
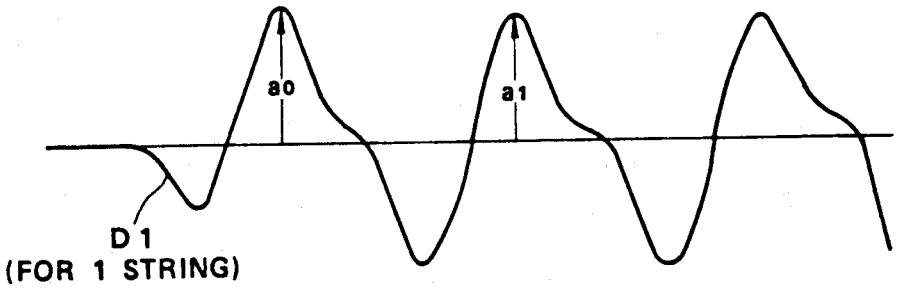

In a normal acoustic guitar, even if the plucking strength remains the same, a hard timbre is obtained when a string is plucked near a bridge, and a soft timbre is obtained when a string is plucked near a fret. In this embodiment, when such a string vibration is detected by the pickup, if the string is plucked near the bridge, a characteristic in which the peak value $a_0$ in the first pitch period becomes larger than the next peak value $a_1$ is obtained, as shown in FIG. 11A. On the other hand, when the string is plucked near the fret, the peak values $a_0$ and $a_1$ become substantially the same values, as shown in FIG. 11B.

In this embodiment, the MCP 3 in FIG. 1 calculates a ratio of the peak values $a_0$ and $a_1$, and transfers the ratio to the musical tone generator 501 as timbre data. Thus, when the value of the timbre data is large, the musical tone generator 501 controls a harmonic envelope or harmonic overtones of a musical tone so that a hard timbre is obtained. On the contrary, when the value is small, the generator 501 controls the harmonic envelope or overtones to obtain a soft timbre. Thus, a musical tone having a timbre according to a string picking position can be generated. In this manner, the characteristic feature of this embodiment is that the tone volume and timbre can be independently controlled.

Since the above-mentioned operation is achieved by time-divisional processing for the time-divisional digital output D1 for the six strings of the guitar, the musical tone generator 501 can simultaneously generate musical tones for the six strings. These musical tones can be set to have desired tone volumes and timbres, and various effects can be electronically added thereto. Therefore, a great performance effect can be obtained.

{Operation of Pitch Extraction Digital Circuit}

An operation of this embodiment for realizing the above-mentioned operation will be described in detail below.

(General Operation)

The operation of the pitch extraction digital circuit 2 shown in FIG. 1 or 2 will be described below. The following description will be made for one string, and the serial zero-cross signal ZCR, the digital output D1, and the maximum and minimum peak value detection signals MAX and MIN will be described for one string.

However, in practice, time-divisional processing is performed for the six strings.

The circuit 2 extracts the peak values $a_0$ to $a_3$ or $b_0$ to $b_3$, and at the same time, extracts zero-cross times $t_1$ to $t_7$ immediately after the corresponding peak values from the digital output D1 shown in FIG. 10 for each of the strings. Furthermore, the circuit 2 extracts data indicating "1" or "0" in accordance with whether the peak value immediately before the corresponding zero-cross time is negative or positive, and supplies the extracted data to the MCP 3 shown in FIG. 1. Based on these data, the MCP 3 extracts the pitch periods $T_0$ to $T_5$ shown in FIG. 10 from intervals of the zero-cross times, generates various musical tone data described above, and performs error processing, note-off (muting) processing, relative-on/off processing, and the like as needed, as will be described later.

(Detailed Operation)

For this purpose, in the peak detector 201 shown in FIG. 2, in response to the digital output D1 input as shown in FIG. 10, the minimum peak value detection signal MIN goes to H level at a timing $x_0$ when the absolute value of the output D1 exceeds 0 in a portion taking a negative value.

In response to this signal, the peak value fetching circuit 203 shown in FIG. 2 detects a minimum peak value (negative peak value) $b_0$ (absolute value) from the separately input digital output D1 at a timing $x_1$ immediately after the minimum peak value detection signal MIN goes to H level, and holds the value in an internal latch (not shown). At the same time, the circuit 203 sets the minimum peak value detection signal MIN at L level.

The serial zero-cross signal ZCR shown in FIG. 10 is input from the pitch extraction analog circuit 1 shown in FIG. 1 to the zero-cross time fetching circuit 204 shown in FIG. 2. This signal is obtained as follows. That is, a comparator (not shown) in the pitch extraction analog circuit 1 determines a positive or negative level of the digital output D1, and outputs an H- or L-level binary digital signal according to the determination result.

The zero-cross time fetching circuit 204 latches time $t_0$ (FIG. 10) counted by the time-base counter 2041 shown in FIG. 2 at an edge timing when the serial zero-cross signal ZCR changes immediately after the minimum peak value detection signal MIN output from the peak detector 201 goes to H level at the timing $x_0$ i.e., the zero-cross timing of the digital output D1. Note that a positive/negative flag of "1" or "0" indicating that an immediately preceding peak value is positive or negative (0 for minimum peak value $b_0$) is added to the most significant bit (MSB) of this latch data.

The zero-cross time fetching circuit 204 outputs the interruption signal INT to the MCP 3 shown in FIG. 1 upon completion of the above-mentioned operation. Thus, when the interruption signal INT is generated, the peak value fetching circuit 203 shown in FIG. 2 holds the minimum peak value $b_0$ (absolute value), and the zero-cross time fetching circuit 204 latches zero-cross time including the positive/negative flag immediately after the minimum peak value $b_0$ is generated.

After the interruption signal INT is output, the MCP 3 in FIG. 1 makes access (to be described later) through the address decoder 4, so that the zero-cross time including the positive/negative flag and the minimum peak value $b_0$ are transferred to the MCP 3 through the bus BUS. Note that since the above-mentioned processing is achieved by the time-divisional processing for the six strings, the zero-cross time fetching circuit 204 outputs data indicating an interrupted string number to the MCP 3 before the respective data are output.

In the peak detector 201 shown in FIG. 2, the internal peak hold circuit (not shown) holds the minimum peak value $b_0$ (absolute value) shown in FIG. 10, and outputs a peak hold signal $q_0$ shown in FIG. 10. In response to this signal, the peak detector 201 again sets the minimum peak value detection signal MIN at H level using the peak hold signal (absolute value) as a threshold value at a timing $x_2$ when the absolute value exceeds the threshold value on the negative side of the digital output D1.

The peak value fetching circuit 203 in FIG. 2 holds the next minimum peak value $b_1$ (absolute value) at a timing $x_3$ immediately after the minimum peak value detection signal MIN goes to H level in the same manner as described above. The zero-cross time fetching circuit 204 in FIG. 2 latches zero-cross time $t_2$ including the positive/negative flag (0 in this case) immediately after the minimum peak value $b_1$ is generated. The held value and the latched time are transferred to the MCP 3 after the interruption signal INT is generated.

Detection of the maximum peak values $a_0$ to $a_3$, and the like, detection of zero-cross times $t_1$, $t_3$, $t_5$, $t_7$, and the like, and output operations of peak hold signals $p_0$ to $p_3$, and the like on the positive side of the digital output D1 are executed in the same manner as the detection of the minimum peak values $b_0$ to $b_3$ (absolute values), and the like, the zero-cross times $t_0$, $t_2$, $t_4$, $t_6$, and the like, and output operations of the peak hold signals $q_0$ to $q_3$, and the like on the negative side of the digital output D1 shown in FIG. 10. Note that in this case, the peak detector 201 outputs the maximum peak value detection signal MAX, as shown in FIG. 10. The peak value fetching circuit 203 and the zero-cross time fetching circuit 204 shown in FIG. 2 latch the maximum peak values $a_0$ to $a_3$, and the like, and zero-cross times $t_1$, $t_3$, $t_5$, $t_7$, and the like including the positive/negative flag (1 in this case because of a positive peak) respectively.

With the above-mentioned operations, the zero-cross time fetching circuit 204 shown in FIG. 2 outputs the interruption signal INT to the MCP 3 shown in FIG. 1 at each of the zero-cross times $t_0$ to $t_7$ shown in FIG. 10, and pairs of minimum or maximum peak values (absolute values) and zero-cross times, such as $b_0$ and $t_0$, $a_0$ and $t_1$, $b_1$ and $t_2$, $a_1$ and $t_3$, . . . , are output to the MCP 3 at the corresponding times based on the interruption signal INT. In the MCP 3, determination of the minimum peak value (negative peak value) or maximum peak value (positive peak value) can be performed by the positive/negative flag added to the MSB of the zero-cross time.

In addition to the above-mentioned operation, the peak value fetching circuit 203 can arbitrarily output an instantaneous value of the digital output D1 upon accessing from the MCP 3. This operation will be described later.

The attenuation factor (time constant) of each of the peak hold signals $p_0$ to $p_3$, $q_0$ to $q_3$, and the like shown in FIG. 10 generated by the peak hold circuit in the peak detector 201 in FIG. 2 are changed by the time constant conversion controller 202 in FIG. 2 under the control of the MCP 3.

Basically, the time constant is changed so that the peak hold signal is immediately attenuated after one pitch period of the digital output D1 has passed. Pitch period data in this case is set in a time constant conversion register CHTRR (to be described later) in the time constant conversion controller 202 through the bus BUS after the MCP 3 in FIG. 1 extracts the pitch periods as will be described later. Thus, the time constant conversion controller 202 compares the content of an internal counter (not shown) for each string with the pitch period data set in the time constant conversion register CHTRR from the MCP 3. When a coincidence output is generated after the pitch period has passed, the controller 202 sends a time constant change signal to the peak detector 201. With this operation, the peak hold circuit is immediately attenuated after one pitch period has passed, and hence, a peak of the next pitch period can be appropriately detected.

When the next maximum or minimum peak value detection signal MAX or MIN is detected by the peak detector 201 before one pitch period passes, the internal counter is reset in response to the trailing edge of the signal, and the next peak hold signal is generated.

A vibration period of each string is widely change depending on a position where a player presses the string on the fret. Therefore, at the leading edge of the waveform of the digital output D1 corresponding to each string, in order to quickly detect the vibration of the waveform, the peak hold signal is set to be immediately attenuated in a highest tone period of each string. Immediately thereafter, the peak hold signal is set to be immediately attenuated in an open string period (lowest tone period) of each string so as not to pick up an overtone of each pitch period. After the pitch period is effectively extracted, the peak hold signal is set to be immediately attenuated in the corresponding pitch period so as to follow a change in pitch period of each string of the digital output D1 by the performance operation.

Furthermore, in the pitch detector 201, whether the peak hold control is to be performed for the positive or negative peak value is determined in accordance with the H- or L-level serial zero-cross signal ZCR (FIG. 10).

{Operationof MCP}

With the above operation, the MCP 3 shown in FIG. 1 performs pitch extraction and extraction of parameters associated with a tone volume and a timbre on the basis of the maximum or minimum peak value, the zero-cross time, and the positive/negative flag indicating a positive or negative peak value supplied from the pitch extraction digital circuit 2 shown in FIG. 1, thereby generating musical tone control data for controlling the musical tone generator 501. Note that the MCP 3 executes the operation flow charts shown in FIGS. 3 to 9 in accordance with the programs stored in the ROM 301, as will be described below.

(Description of Variables)

Variables used in the control programs shown in the operation flow charts of FIGS. 3 to 9 (to be described later) will be described below.

AD . . . input amplitude value (instantaneous value) obtained by directly reading the input waveform D1 to the pitch extraction digital circuit 2 in FIG. 1

AMP(0,1) . . . positive or negative old peak value

AMRL1 . . . old amplitude value (peak value) stored in an amplitude register and used for a "relative-off" check. The "relative-off" operation means muting operation on the basis of immediate attenuation of the peak value, and corresponds to muting processing when a fret operation is finished, thereby becoming an open string status.

AMRL2 . . . amplitude value (peak value) before the old amplitude value stored in the amplitude register and used for the relative off operation. The value AMRL1 is input as this value.

CHTIM . . . period corresponding to a highest tone fret (22nd fret in this embodiment)

CHTIO . . . period corresponding to an open string fret

CHTRR . . . time constant conversion register arranged in the time constant conversion controller 202 (FIG. 2)

DUB . . . flag indicating that waveforms in the same direction (positive/negative direction) are successively input FOFR . . . relative-off counter HNC . . . waveform number counter MT . . . flag (positive=1, negative=0) indicating a side for which pitch extraction is to be performed NCHLV . . . no change level (constant)

OFTIM . . . off time (corresponding to an open string period of the corresponding string)

OFPT . . . normally off check start flag

ONF . . . note-on flag

RIV . . .flag for switching a processing route in STEP 4 (to be described later)

ROFCT . . . constant for determining the number of times of relative-off check

STEP . . . register (taking a value between 0 to 4 or 5) for designating a flow operation of the MCP 3

TF . . . valid old zero-cross time data

TFN(0,1) . . . old zero-cross time data immediately after a positive or negative peak value TFR . . . time storing register THLIM . . . upper limit frequency (constant)

TLLIM . . . lower limit frequency (constant)

TP(0,1) . . . positive or negative old period data

TRLAB(0,1) . . . positive or negative absolute trigger level (note-on threshold value)

TRLRL . . . threshold value for relative-on operation (restart of tone generation)

TRLRS . . . resonance removal threshold value

TTLIM . . . lower limit frequency upon triggering

TTP . . . previously extracted period data

TTR . . . period register

TTU . . . constant (product of 17/32 and present period data tt)

TTW . . . constant (product of 31/16 and present period data tt)

VEL . . . data for determining a velocity, and determined by the maximum peak value of the waveform at the beginning of tone generation (string vibration)

X . . . flag indicating an abnormal or normal state b . . . present positive/negative flag stored in a working register B (1 for the next zero point of a positive peak; 0 for the next zero point a negative peak)

c . . . present peak value stored in a working register c e . . . peak value before the old peak value, stored in a working register E h . . . period data extracted in a period before the immediately preceding period, which is stored in a working register H t . . . present zero-cross time stored in a working register T0 tt . . . present period data stored in a working register TOTO (Operation of Interruption Processing Routine)

Figure 3:
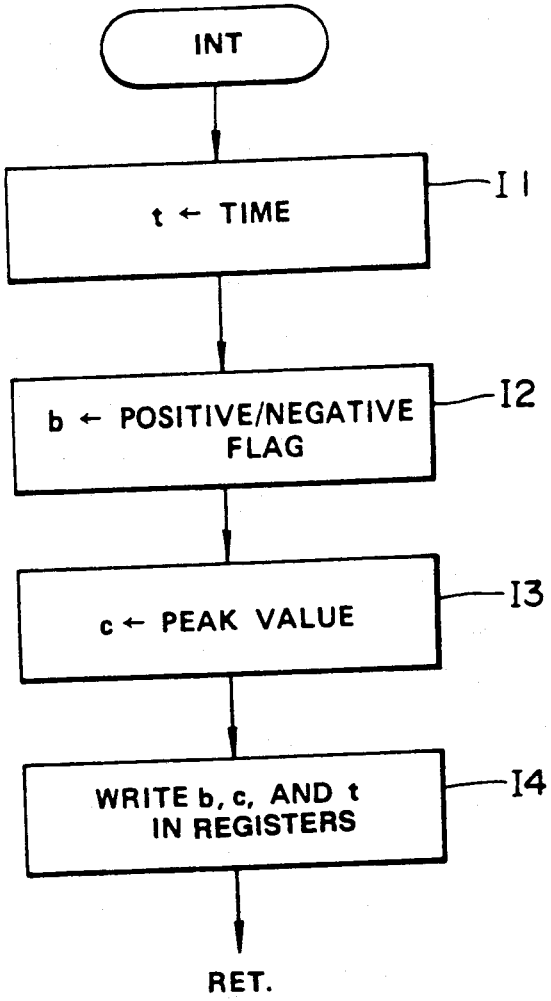
FIG. 3 is an operation flow chart of an interruption processing routine.

FIG. 3 is an operation flow chart of an interruption processing routine showing a processing to be executed when an interruption is performed in response to the interruption signal INT from the zero-cross time fetching circuit 204 (FIG. 2) in the pitch extraction digital circuit 2.

As described above, when the interruption signal INT is output from the zero-cross time fetching circuit 204, the peak value fetching circuit 203 in FIG. 2 holds the maximum or minimum peak value (absolute value), and the zero-cross time fetching circuit 204 latches the zero-cross time immediately after the corresponding peak value is generated and the positive/negative flag indicating "1" when the immediately preceding peak value is the maximum (positive) peak value and "0" when it is the minimum (negative) peak value.

In step I1 in FIG. 3, the MCP 3 sets a predetermined address read signal AR in the address decoder 4, and causes the zero-cross time fetching circuit 204 in FIG. 2 to output the string number read signal $\overline{RDNUM}$. The circuit 204 thus outputs, to the MCP 3 through the bus BUS, the string number data indicating a string number for which the interruption occurs. Subsequently, the MCP 3 sets another address read signal AR in the address decoder 4, and causes the zero-cross time fetching circuit 204 to output a signal corresponding to the string number of the time read signals $\overline{RDTIM1}$ to $\overline{RDTIM6}$. The circuit 204 outputs, to the MCP 3 through the bus BUS, zero-cross time data set in a latch corresponding to the string number by the output time read signal $\overline{RDTIMi}$ (i=1 to 6). This time data is set as the present zero-cross time t, as shown in step I1 in FIG. 3.

In step I2 in FIG. 3, as has been described in Section "Operation of Pitch Extraction Digital Circuit", the positive/negative flag added to the MSB of the zero-cross time data is extracted, and is set as the present positive/negative flag b.

Thereafter, in step I3 in FIG. 3, the MCP 3 causes the peak value fetching circuit 203 in FIG. 2 to output a peak value read signal $\overline{RDAj}$ (j=1 to 12) through the address decoder 4 in the same manner as described above. Note that since the circuit 203 includes 12 latches (not shown) for holding maximum and minimum peak values for the six strings, the MCP 3 causes the address decoder 4 to selectively output the peak value read signal $\overline{RDAj}$ on the basis of the string number of the positive/negative flag b. Thus, the maximum or minimum peak value (absolute value) set in the latch designated by the peak value read signal $\overline{RDAj}$ is output from the circuit 203 to the MCP 3 through the bus BUS. This peak value is set as the present peak value c, as shown in step I3 in FIG. 3.

After the above operations, in step I4 in FIG. 3, the values t, c, and b obtained as described above are set in registers T0, C, and B (not shown). Every time the interruption processing is executed, a set of the zero-cross time data, the peak value data (absolute value), and the positive/negative flag data is set in these registers. In a main routine (to be described later), processing for data associated with each string is performed.

The registers T0, C, and B are arranged six each in correspondence with the six strings. Musical tone control processing to be described with reference to FIGS. 4 to 9 is time-divisionally performed for the six strings, but will be described for one string for the sake of descriptive convenience.

(Operation of Main Routine)

Figure 4:
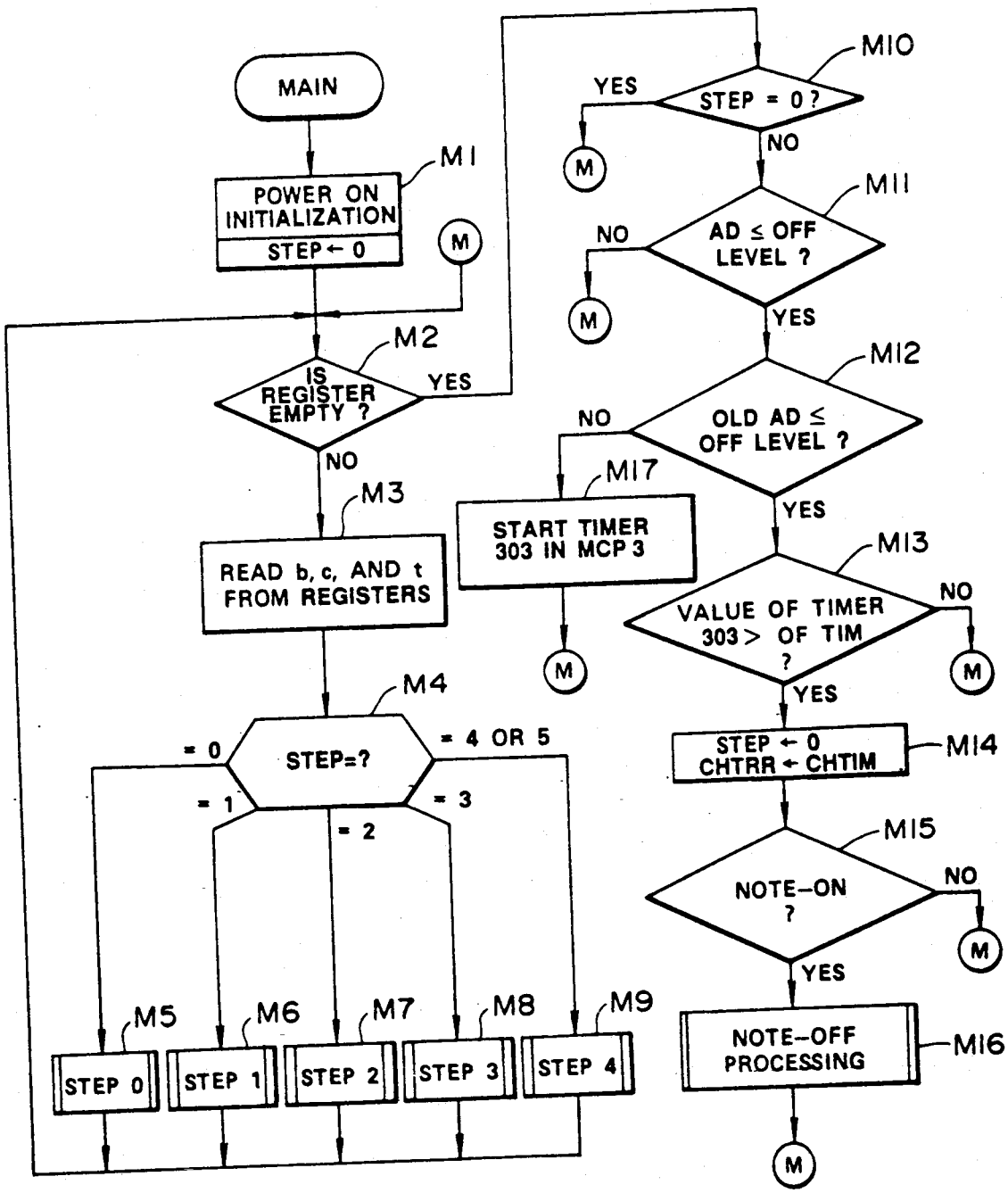
FIG. 4 is an operation flow chart of a main routine.

FIG. 4 is an operation flow chart showing the main routine processing. In this routine, initialization after power-on, note-off (muting) processing of a musical tone, and selection processing of operations of STEP 0 to STEP 4 (or 5) are performed. In this embodiment, as will be described later, musical tone control processing is performed according to the processing concept named "STEP", that is, musical tone control is performed in the order of STEP 0→STEP 1→STEP 2→STEP 3→STEP 4 (→STEP 5)→STEP 0, as will be described later.

<Basic Operation>

In FIG. 4, when a power switch is turned on, various registers and flags are initialized in step M1, and the register STEP is set to be "0". In this case, as has been described in the description of the time constant conversion controller 202 (FIG. 2) in Section "Operation of Pitch Extraction Digital Circuit", the MCP 3 sets the highest tone fret period CHTIM in the time constant conversion register CHTRR in the time constant conversion controller 202 through the bus BUS, so that the peak detector 201 (FIG. 2) can quickly detect a vibration at the leading edge of the waveform of the digital output D1. Thus, control is performed so that the peak hold signal ($p_0$ or $q_0$ in FIG. 10) output from the peak hold circuit in the peak detector 201 is immediately attenuated in the highest tone period time.

Subsequently, in step M2 in FIG. 4, it is checked if the register described in Section "Operation of Interruption Processing Routine" is empty. If NO in step M2, the flow advances to step M3, and the contents of the registers B, C, and T0 are read. In step M4, the value of the register STEP is checked. Processing operations of STEP 0, STEP 1, STEP 2, STEP 3, and STEP 4 are sequentially executed in steps M5, M6, M7, M8, and M9. Note that updating to the next STEP is performed in the processing of STEP 0 to STEP 4, as will be described later.

<Noteff/ Operation>

If it is determined in step M2 that the register is empty, i.e., YES in step M2, the control advances to processing in steps M10 to M16. In these steps, normal note-off algorithm processing is performed. In this note-off algorithm, if a state wherein the peak value of the digital output D1 (FIG. 1) is equal to or smaller than an OFF level is continued for a predetermined off time, a note-off operation is performed.

It is checked in step M10 if STEP=0. If YES in step M10, the note-off operation need not be performed since an initial state wherein no musical tone is generated is detected. Thus, the flow returns to step M2. If NO in step M10, the flow advances to step M11.

In step M11, the input peak value (instantaneous value) AD of the digital output D1 at that time is directly read. This can be achieved as follows. The MCP 3 supplies one of the peak value read signals $\overline{RDA13}$ to $\overline{RDA18}$ to the peak value fetching circuit 203 (FIG. 2) through the address decoder 4, so that the circuit 203 outputs the present instantaneous value of the digital output D1 to the MCP 3 through the bus BUS. It is then checked if this value AD is equal to or smaller than a preset OFF level. If NO in step M11, the flow returns to step M2 since the note-off operation need not be performed. However, if YES in step M11, the flow advances to step M12.

It is checked in step M12 if the old input peak value AD is equal to or smaller than the OFF level. If NO in step M12, the flow advances to step M17, and the timer 303 in the MCP 3 is started. The flow then returns to step M2. When the control comes again to this processing, since YES is obtained in step M12, the flow advances to step M13 to check if the value of the timer 303 is equal to the off time OFTIM. As the off time OFTIM, the open string fret period CHTIO of a string subjected to processing is set. If NO in step M13, the flow returns to step M2 to repeat the above-mentioned processing. If YES in step M13, the flow advances to step M14, and data "0" is written in the register STEP and the highest tone fret period CHTIM is set in the time constant conversion register CHTRR. Thereafter, the flow advances to step M16 via step M15 (to be described later). More specifically, when the level of the digital output D1 becomes attenuated, if the input peak value AD equal to or smaller than the OFF level is kept unchanged for a time period corresponding to the off time OFTIM, it can be determined that no digital output D1 is input and a plucking operation of a string is stopped. Thus, the flow then advances to step M16, and note-off processing is performed.

In step M16, the MCP 3 sends a note-off instruction to the musical tone generator 501 (FIG. 1), thus stopping generation of a musical tone. In this manner, when the note-off processing is performed, the flow must return to STEP 0.

In a normal state, YES is obtained in step M15. However, with processing to be described below, the register STEP may take a value other than 0 even when a generation instruction of a musical tone is not performed (caused by, e.g., a noise input). In this case, the flow returns to step M2 after the processing in steps M14 and M15, so that the register STEP can be initialized to STEP 0.

(Processing/ Operation in STEP 0)

Each routine branching from the main routine shown in FIG. 4 and performing the corresponding processing will be described below.

Figure 5:
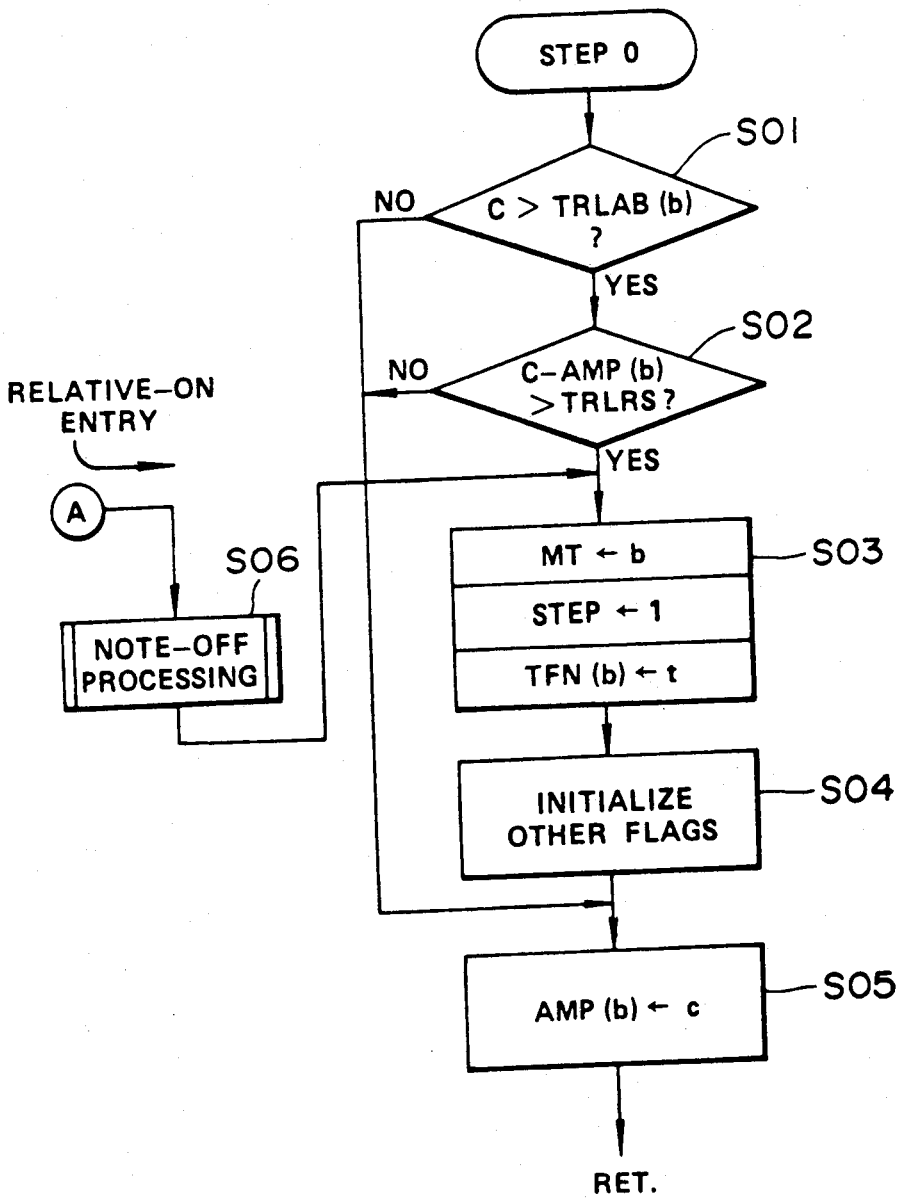
FIG. 5 is an operation flow chart of STEP 0.
Figure 12:
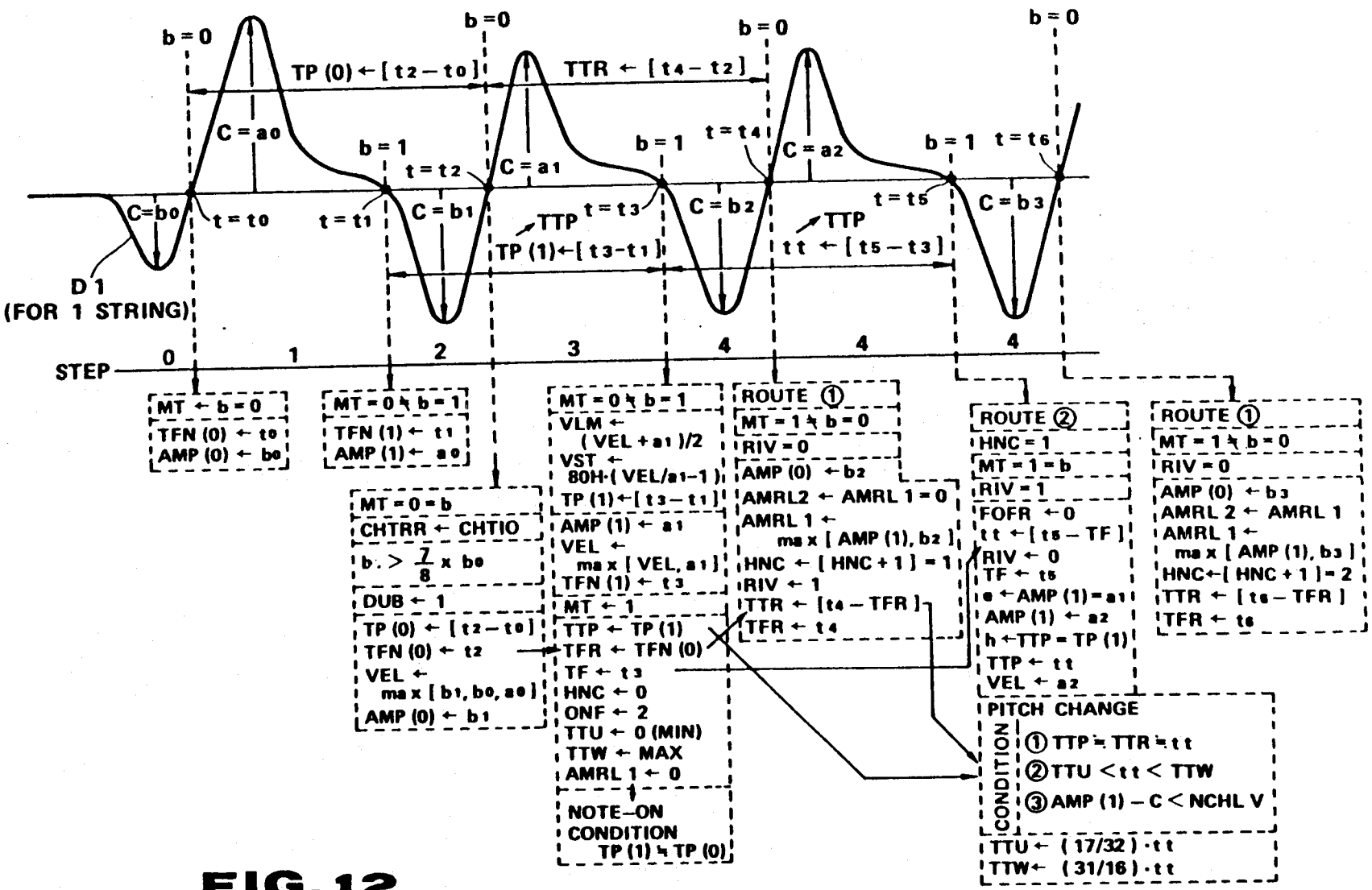
FIG. 12 is a chart for explaining a basic operation of this embodiment.

FIG. 5 is an operation flow chart of processing in STEP 0 as step M5 in the main routine shown in FIG. 4. In this processing, initialization for pitch extraction processing, and the like, and transition processing to next STEP 1 are performed. A description will be made with reference to the chart of FIG. 12 for explaining the basic operation. Note that a waveform in FIG. 12 is the same as that in FIG. 10.

<Basic Operation>

Now, the main routine shown in FIG. 4 waits for data input to the registers T0, C, and B upon interruption from the pitch extraction digital circuit 2 (FIG. 1) by repeating the loop of steps M2 and M10, as has been described in Section "Operation of Interruption Processing Routine".

When data is input and the contents of the registers are read in step M3 in FIG. 4, the flow advances to step M5 via step M4, i.e., the control transits to STEP 0 in FIG. 5. In this state, for example, as shown in FIG. 12, the present zero-cross time $t=t_0$, the positive/negative flag $b=0$, and the present peak value is the minimum peak value $c=b_0$ (absolute value) since $b=0$. Note that in FIG. 12, b and $b_0$ to $b_3$ and the like are different symbols.

It is checked in step S01 in FIG. 5 if the present peak value c is larger than the absolute trigger level (positive threshold value for note-on operation) TRLAB(b). This checking operation is executed for positive and negative polarities on the basis of the value of the present positive/negative flag b. The positive absolute trigger level TRLAB(1) and the negative absolute trigger level TRLAB(0) can be set to be different values according to an experience in consideration of a case wherein an offset is superposed on the digital output D1 (FIG. 1). In an ideal system, these trigger levels can be the same value. In FIG. 12, the present minimum peak value $c=b_0$ (absolute value) is compared with TRLAB(b)=TRLAB(0), and yields $c=b_0>$TRLAB(0), that is, YES is obtained in step S01.

After step S02 (to be described later), processing in step S03 is executed. The present positive/negative flag b is written in a flag MT, and data "1" is written in the register STEP to prepare for transition to the next step. Furthermore, the present zero-cross time t is set as old zero-cross time data TFN(b) for the following processing. In FIG. 12, $MT=b=0$, and $TFN(b)=TFN(0)=t=t_0$.

In step S04, flags (excluding constants) other than the flags described in the Section "Description of Variables" are initialized.

In step S05, the present peak value c is set as an old peak value AMP(b) (absolute value) for the following processing, and the flow returns to step M2 in the main routine in FIG. 4. In FIG. 12, $AMP(b)=AMP(0)=c=b_0$.

With the above processing, in FIG. 12, the present positive/negative flag $b=0$ of the register B is written in the flag MT, the present zero-cross time data $t=t_0$ of the register T0 is written as the negative old zero-cross time data TFN(0), and the present minimum peak value $c=b_0$ of the register C is written as the negative old peak value AMP(0), as indicated between STEP 0 and STEP 1.

<Resonance Removal Operation>

Note that if it is determined in step S01 in FIG. 5 that the present peak value c is equal to or smaller than the absolute trigger level TRLAB(b), the control does not transit to the note-on processing. In this case, only the present peak value c is set as the old peak value AMP(b) in step S05, and the flow returns to the main routine shown in FIG. 4. However, when one string is plucked and another string is resonated, the vibration level of the another string is gradually increased. YES is then obtained in step S01 in FIG. 5, and the flow advances to the processing in step S02. However, in this case, since no regular plucking operation is performed, it is not proper that the control transits to the note-on operation. Thus, in the processing in step S02, the resonance is removed. More specifically, in this case, since the present peak value c is not almost increased as compared to the old peak value AMP(b), when a difference c−AMP(b) is not larger than the resonance removal threshold value TRLRS, it is determined that the resonance state occurs. Thus, the control does not transit to the note-on processing, and the present peak value c is set in the old peak value AMP(b) in step S05, and the flow returns to the main routine in FIG. 4. On the other hand, when a regular plucking operation is performed, as shown in FIG. 12, a waveform rises immediately, and the difference c−AMP(b) of the peak values exceeds the resonance removal threshold value TRLRS, and the flow advances from step S02 to step S03, as described above.

<Relative On Entry Operation>

In FIG. 5, a node A corresponds to a relative-on (tone regeneration start) entry, and the flow jumps from the flow in STEP 4 (to be described later) to step S06. In step S06, the present output musical tone is muted, and the flow advances to step S03 to start tone regeneration. Processing for starting tone regeneration is the same as that when normal tone generation is started, as described above. Note-off processing in step S06 is the same as that in step M16 in FIG. 4.

(Processing Operation in STEP 1)

Figure 6:
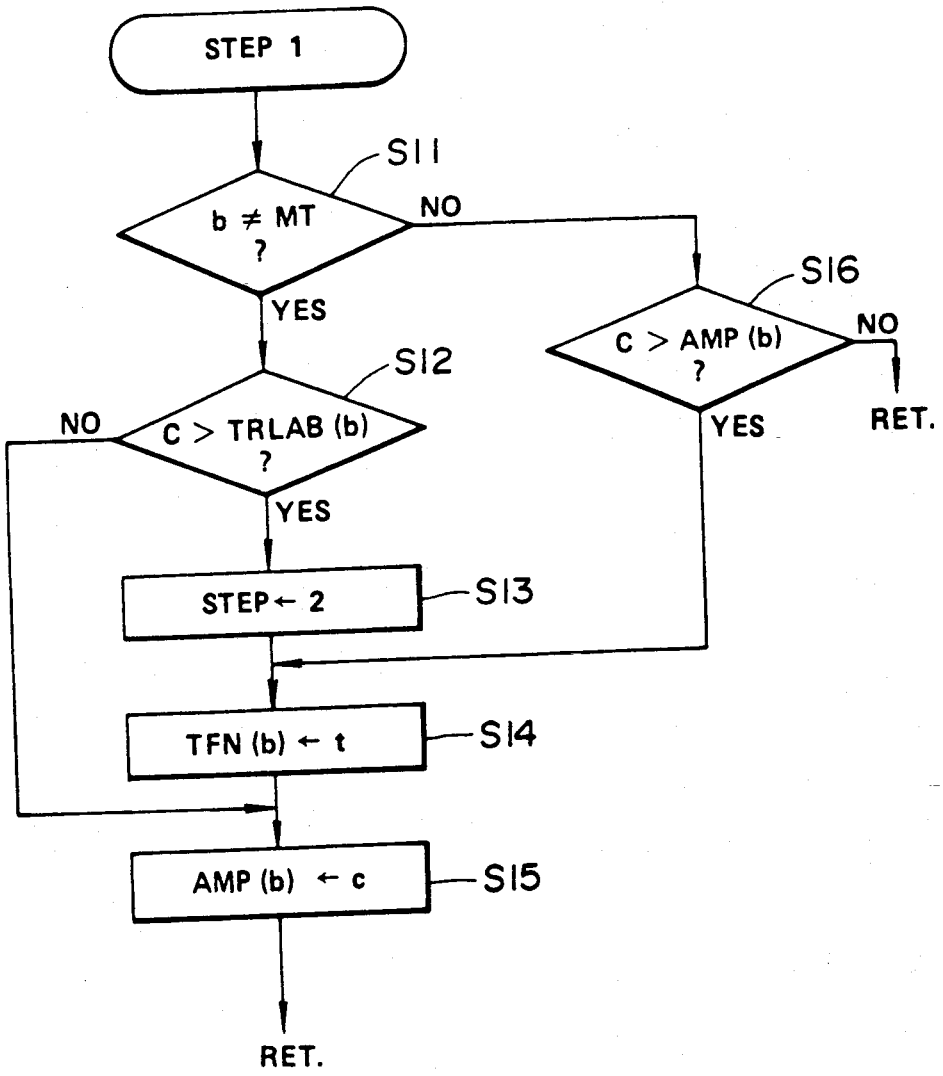
FIG. 6 is an operation flow chart of STEP 1.

FIG. 6 is an operation flow chart of processing in STEP 1 as step M6 in the main routine shown in FIG. 4. In this processing, initialization for pitch extraction processing after STEP 0, transition processing to following STEP 0 or repetition processing (error processing) when an abnormal waveform is input, and the like are performed.

<Basic Operation>

After initialization for the first data is performed in STEP 0, the main routine shown in FIG. 4 waits for data input to the registers T0, C, and B upon interruption from the pitch extraction digital circuit 2 (FIG. 1) by repeating the loop of step M2→M10→M11→M2.

When data is input and the contents of the registers are read in step M3 in FIG. 4, the flow advances to step M6, i.e., STEP 1 in FIG. 6 via step M4. In this state, for example, as shown in FIG. 12, the present zero-cross time $t=t_1$, the present positive/negative flag b=1, and the present peak value is the maximum peak value $c=a_0$ since b=1.

After step S11 in FIG. 6 (to be described later), it is checked in step S12 if the present peak value c is larger than the absolute trigger level TRLAB(b), in the same manner as has been described in a description of step S01 in FIG. 5 in Section "Processing Operation in STEP 0". In FIG. 12, the present maximum peak value is compared with TRLAB(b)=TRLAB(1) and yields $c=a_0>$TRLAB(1), that is, YES is obtained in step S12.

In step S13, data "2" is written in the register STEP to prepare for transition to the next step. In step S14, the present zero-cross time t of the register T0 is set as old zero-cross time data TFN(b) for the following processing. In step S15, the present peak value c of the register C is set as the old peak value AMP(b) for the following processing, and the flow returns to the processing in step M2 of the main routine shown in FIG. 4. In FIG. 12, TFN(1)=$t=t_1$, and AMP(1)=$c=a_0$. Note that the content of the flag MT is not rewritten and is kept to be "0".

<Operation of Repetition Processing>

When the normal digital output D1 as shown in FIG. 12 is input, after the negative (minimum)/positive (maximum) peak value (absolute value) is extracted in STEP 0, other side peak value i.e., positive (maximum/negative (minimum) peak value is extracted in STEP 1. Therefore, in step S11 in FIG. 6, since the present positive/negative flag b=1 (0) is different from the flag MT=0 (1) set in STEP 0, the flow advances to step S12, as described above.

Figure 13A:
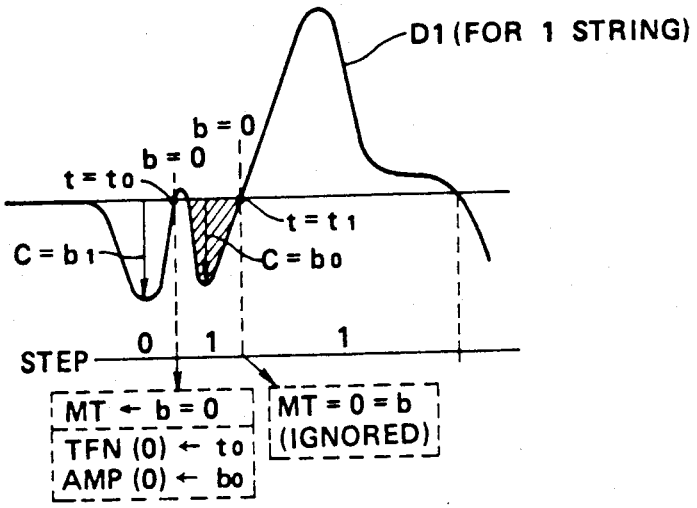
FIGS. 13A and 13B are charts for explaining repetition processing in STEP 1.
Figure 13B:
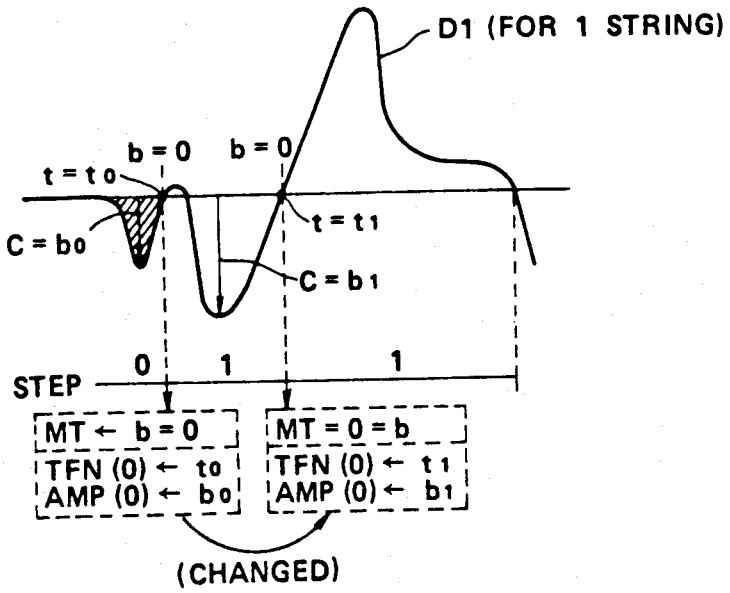

However, in some cases, a waveform shown in FIG. 13A or 13B may be input in STEP 1 after STEP 0. In this case, after the negative minimum peak value $b_0$ is extracted in STEP 0, the negative minimum peak value $b_1$ is repetitively extracted in STEP 1. Therefore, in step S11 in FIG. 6, the present positive/negative flag b=0, and coincides with the flag MT=0 set in STEP 0. In this case, the flow advances to step S16 in FIG. 6, and repetition processing (error processing) is executed.

It is checked in step S16 if the peak value c is larger than the old peak value AMP(b) having the same sign.

In the case of FIG. 13A, $c=b_1>$AMP(b)=AMP(0)=$b_0$ cannot be established. In this case, the present minimum peak value $b_1$ is ignored as an abnormal waveform (hatched portion), and the content of the register STEP is not updated. The flow returns to the processing in step M2 in the main routine shown in FIG. 4, and inputting of the next normal peak is waited for.

In the case of FIG. 13B, $c=b_1>$AMP(b)=AMP(0)=$b_0$ be established. In this case, the minimum peak value $b_0$ extracted in the preceding STEP 0 is ignored as an abnormal waveform (hatched portion), and the contents of the negative old zero-cross time data TFN(0) and negative old peak value AMP(0) set in STEP 0 are updated to the present zero-cross time t and the present peak value c in steps S14 and S15 in FIG. 6. More specifically, in FIG. 13B, TFN(0)=$t=t_1$ and AMP(0)=$c=b_1$. After the repetition processing, the content of the register STEP is not updated (without going through step S13 in FIG. 6), and the flow returns to the processing in step M2 of the main routine in FIG. 4. Thus, inputting of the next normal peak is waited for.

After the above-mentioned operation, when the normal peak value is input, the above-mentioned processing is performed in step S11→S12→S13→S14→S15 in FIG. 6, and for example, when $t=t_1$, the control transits to the next processing of STEP 2, as shown in FIG. 12.

(Processing Operation in STEP 2)

Figure 7:
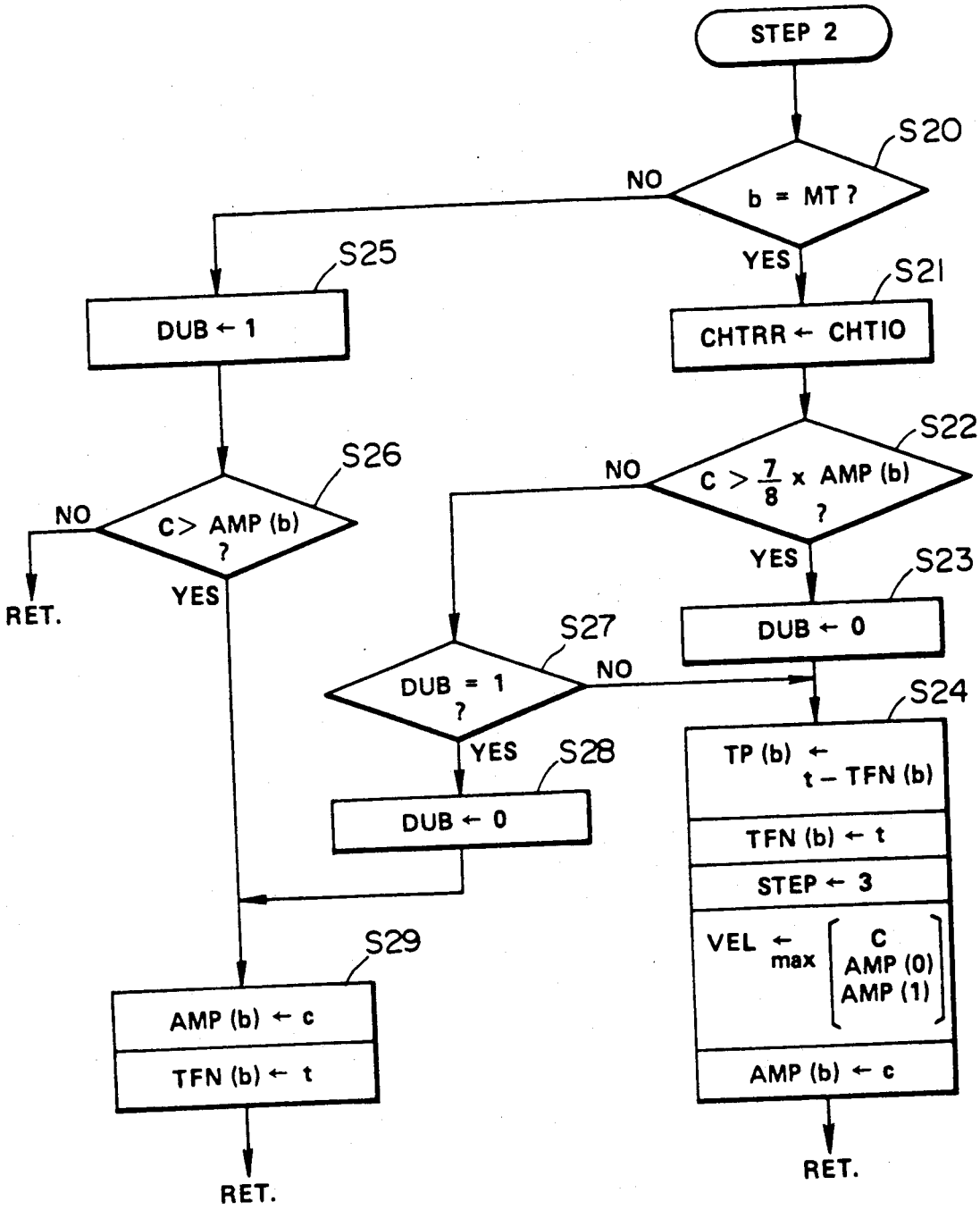
FIG. 7 is an operation flow chart of STEP 2.

FIG. 7 is an operation flow chart of the processing in STEP 2 as step M7 in the main routine of FIG. 4. In this processing, detection of a first pitch period for pitch extraction, setting of a velocity, transition processing to STEP 3 or error processing (repetition processing) when an abnormal waveform is input, and the like are executed.

<Basic Operation>

After the processing in STEP 1 is performed, the main routine shown in FIG. 4 waits for data input to the registers T0, C, and B upon interruption again from the pitch extraction digital circuit 2 (FIG. 1) by repeating the loop of step M2→M10→M11→M2.

When data is input and the contents of the registers are read in step M3 in FIG. 4, the flow advances to step M7, i.e., STEP 2 in FIG. 7 via step M4. In this state, for example, as shown in FIG. 12, the present zero-cross time $t=t_2$, the present positive/negative flag b=0, and the present peak value is the minimum peak value $c=b_1$ since b=0.

After step S20 in FIG. 7 (to be described later), in step S21, the MCP 3 sets the open string fret period CHTIO of a string, which is presently subjected to processing, in the time constant conversion register CHTRR in the time constant conversion controller 202 in FIG. 2 through the bus BUS. As has been described with reference to the time constant conversion controller 202 in Section "Operation of Pitch Extraction Digital Circuit", after the peak detector 201 (FIG. 2) detects a vibration at the leading edge of the waveform of the digital output D1, the peak hold signal ($p_1$, $q_2$, and the like in FIG. 10) output from the peak hold circuit in the peak detector 201 is immediately attenuated in the lapse of an open string period of each string, i.e., a lowest tone period CHTIO so that the detector 201 does not pick up an overtone of each pitch period.

It is checked in step S22 if the present peak value c is larger than a $\frac{7}{8}$ multiple of the old peak value AMP(b) having the same sign. As will be described later, since a waveform obtained by plucking a string is naturally attenuated, YES is obtained in step S22, and the flow advances to step S24 via step S23 (to be described later).

In step S24, {(present zero-cross time t)−(old zero-cross time data TFN(b) having the same sign} is calculated to detect the first pitch period. The difference is set as old period data TP(b) so as to be used as a note-on (tone generation start) condition in STEP 3 (to be described later). In FIG. 12, $TP(0)=t-TFN(0)=t_2-t_0$.

In step S24, the present zero-cross time t is set as the old zero-cross time data TFN(b) for the following processing. In FIG. 12, $TFN(0)=t=t_2$. Note that $TFN(0)=t_0$ set in STEP 0 is no longer necessary and is erased since the old period data $TP(b)=TP=t_0$ can be calculated.

In step S24, data "3" is written in the register STEP to prepare for transition to the next step.

Furthermore, in step S24, for the following processing, a largest one of the present peak value c, and the old peak values AMP(0) and AMP(1) is set as the velocity VEL. Note that the velocity VEL is used as a value for determining a tone volume of a musical tone, as will be described later in STEP 3. Similarly, the present peak value c is set as the old peak value AMP(b), and the flow returns to the processing in step M2 of the main routine shown in FIG. 4. In FIG. 12, $VEL=\max\{c, AMP(0), AMP(1)\}=\max\{b_1, b_0, a_0\}$, and hence, $AMP(0)=c=b_1$. Note that $AMP(0)=b_0$ set in STEP 0 is no longer necessary and is erased since the velocity VEL can be calculated.

<Operation of Repetition Processing>

When the normal digital output D1 as shown in FIG. 12 is input, after the positive (maximum)/negative (minimum) peak value is extracted in STEP 1, the other peak value i.e., negative (minimum)/positive (maximum) peak value is extracted in STEP 2. Therefore, in this case, the sign of the peak value in STEP 2 is opposite to that in STEP 1, and is the same as that in STEP 0. In step S20 in FIG. 7, the present positive/negative flag b=0 (1) coincides with the flag MT=1 (0) set in STEP 0, and the flow advances to step S21, as described above.

Figure 14A:
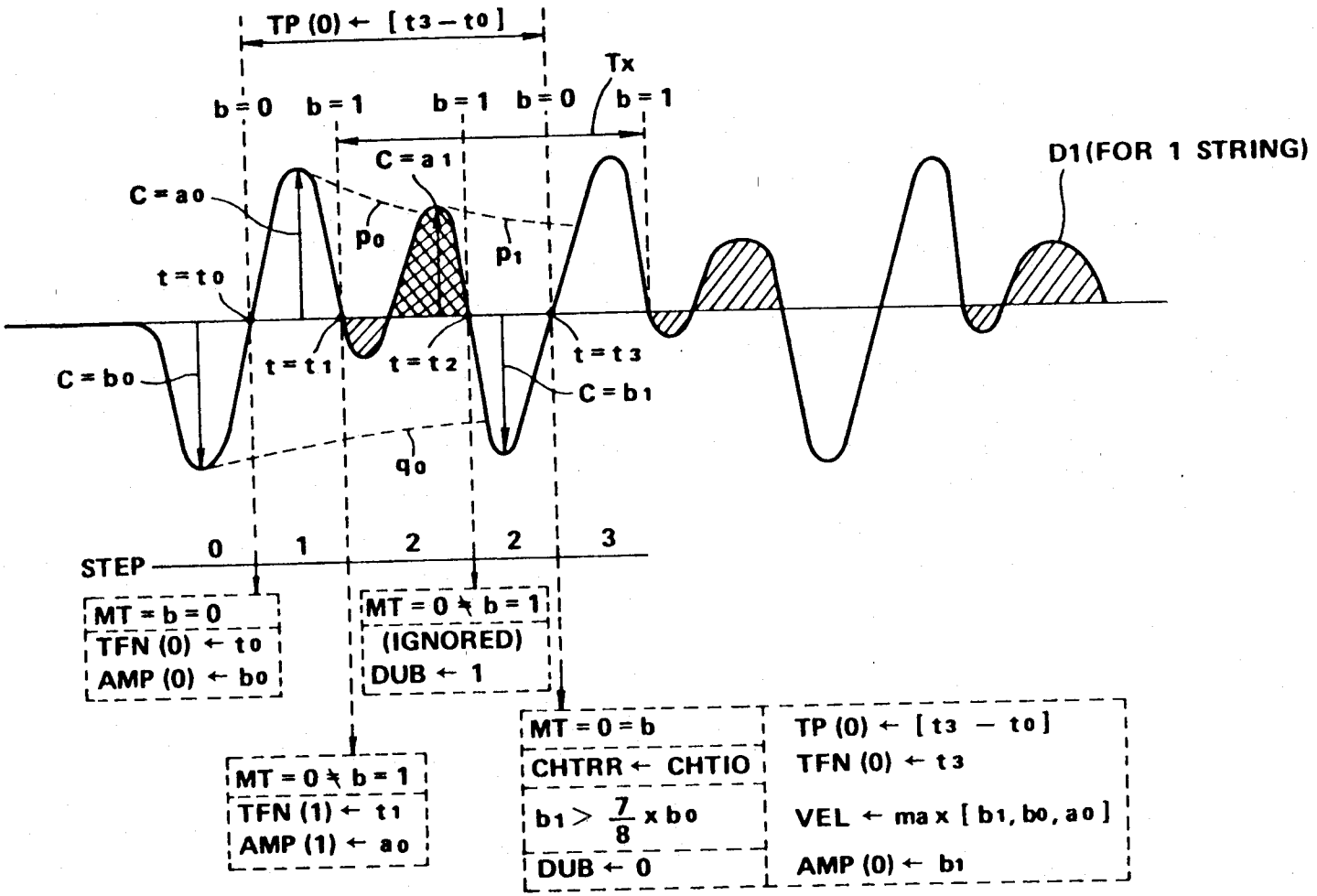
FIGS. 14A, 14B, and 14C are charts for explaining repetition processing in STEP 2.
Figure 14B:
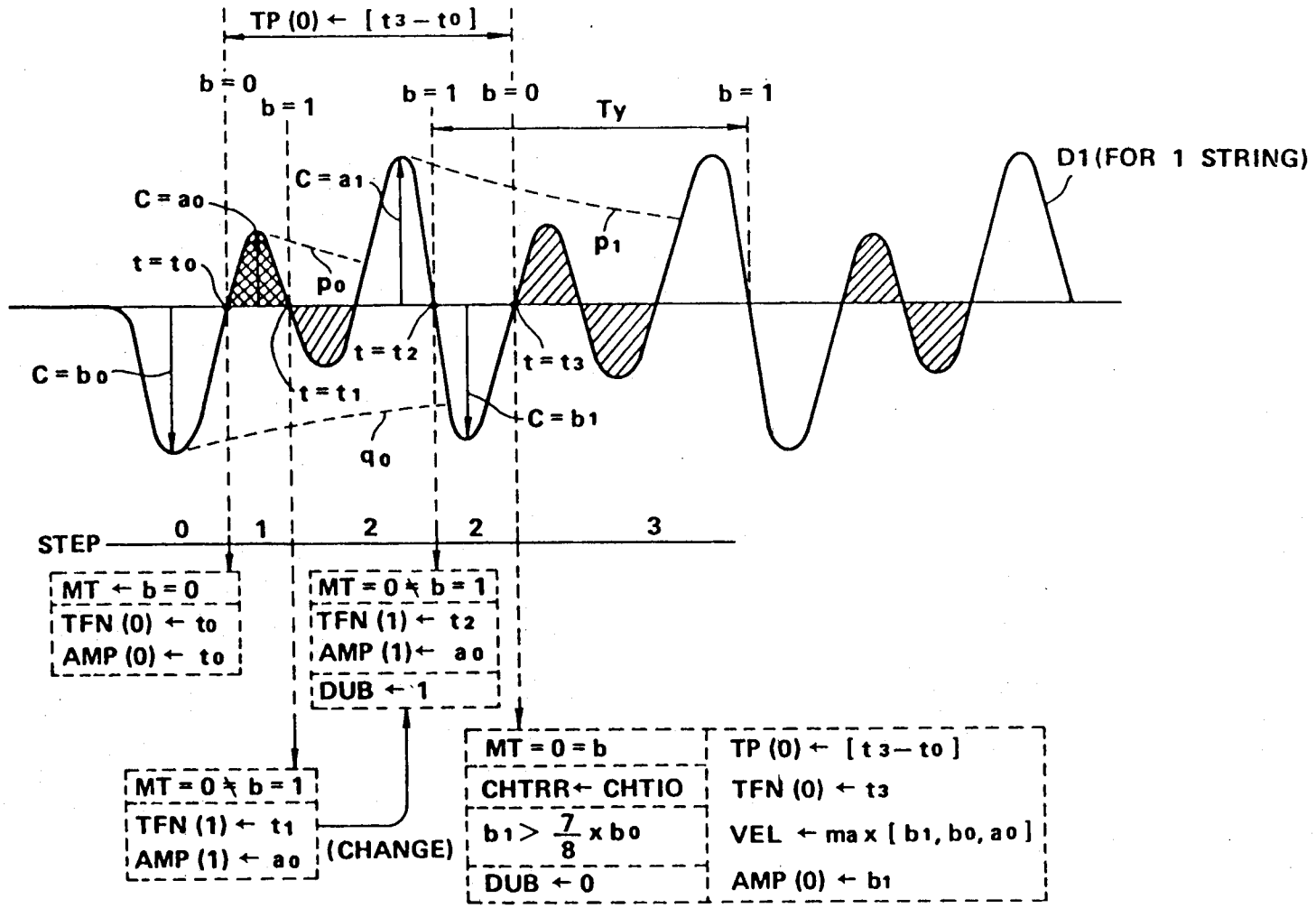

However, as has been described in the description of Sub-section "Operation of Repetition Processing" in Section "Processing Operation in STEP 1", waveforms may be repetitively input after STEP 1, as shown in FIG. 14A or 14B. In this case, after the positive (maximum) peak value $a_0$ is extracted in STEP 1, the positive (maximum) peak value $a_1$ is repetitively extracted in STEP 2. Therefore, in step S20 in FIG. 7, the present positive/negative flag b=1, and coincides with the flag MT=0 set in STEP 0. In this case, the flow advances to step S25, and repetition processing (error processing) is executed. Note that peaks indicated by simple hatching are not picked up as the peak hold signals $p_0$, $p_1$, $q_0$, and the like shown in FIG. 14A or 14B generated from the peak hold circuit in the peak detector 201 shown in FIG. 2, and are not detected as peak values.

In step S25, the repetition flag DUB is set to be "1" (to be described later), and the flow then advances to step S26 to check if the present peak value c is larger than the old peak value AMP(b) having the same sign.

Assuming that STEP 2 is executed at $t=t_2$ after STEP 0 ($t=t_0$) and STEP 1 ($t=t_1$), $C=a_1>AMP(b)=AMP(1)=a_0$ cannot be established. More specifically, NO is obtained in step S26 in FIG. 7. In this case, the present peak value $a_1$ is ignored as an abnormal waveform (cross-hatched portion in FIG. 14A). Thus, the register STEP is not updated, and the flow returns to the processing in step M2 in the main routine shown in FIG. 4 to wait for the next normal peak. When the minimum peak value $c=b_1$ is input at $t=t_3$, YES is obtained in step S20 in FIG. 7, and the processing in step S21→S22→S23→S24 is executed in the same manner as in FIG. 12. At $t=t_3$ in FIG. 14A, the control transits to the next processing in STEP 3. Note that the old period data TP(0) set in step S24 in FIG. 7 corresponds to a difference between the present zero-cross time $t_3$ and the old zero-cross time $t_0$ set in STEP 0, as shown in FIG. 14A. The start point of the next period data $T_x$ calculated in STEP 3 (to be described later) corresponds to the old zero-cross time $TFN(1)=t_1$ set in STEP 1 since the cross-hatched peak ($c=a_1$) is ignored, as shown in FIG. 14A.

On the contrary, in FIG. 14B, $c=a_1>AMP(b)=AMP(1)=a_0$ can be established. That is, YES is obtained in step S26 in FIG. 7. In this case, the maximum peak value $a_0$ extracted in the preceding STEP 1 is ignored as an abnormal waveform (cross-hatched portion in FIG. 14B), and the contents of the old zero-cross time data TFN(l) and the positive old peak value AMP(1) are updated to the present zero-cross time t and the present peak value c in step S29 in FIG. 7. More specifically, in FIG. 14B, $TFN(1)=t=t_2$ and $AMP(1)=c=a_0$. After the repetition processing, the register STEP is not updated, and the flow returns to the processing in step M2 in the main routine shown in FIG. 4 to wait for inputting of the next normal peak value. Thereafter, the processing after the minimum peak value $c=b_1$ is input at $t=t_3$ is the same as that in FIG. 14A. However, since the peak (cross-hatched peak $c=a_0$ in FIG. 14B) extracted in STEP 1 is ignored and is updated to the peak $c=a_1$, the start point of the next period data $T_x$ of TP(0) calculated in STEP 3 (to be described later) corresponds to the old zero-cross time $TFN(1)=t_2$ set in the repetition processing in STEP 2, and is different from that in FIG. 14A.

As shown in FIG. 14A or 14B, when waveforms are repetitively input, a peak having a smaller peak value is ignored as an abnormal waveform, and error processing is executed.

A branch at step S22 in FIG. 7 for other cases of the repetition processing will be explained below.

When the processing in STEP 2 in FIG. 7 is executed, since a normal waveform obtained by picking a string is smoothly and naturally attenuated, the present peak value becomes larger than a $\frac{7}{8}$ multiple of the old peak value AMP(b) having the same sign in step S22, and YES is obtained in step S22. Thus, the flow advances to step S23.

In some cases, however, $c>(\frac{7}{8})\times AMP(b)$ cannot be established. In a first case, as has been described in Section "General Operation of This Embodiment", when a string is plucked near the bridge, a waveform shown in FIG. 11A is generated. In this case, although the waveform is normal, it is not smoothly attenuated, and NO may often be obtained in step S22. In this case, the processing in step S24 in FIG. 7 must be normally performed. Since the waveform is normal, the above-mentioned repetition does not occur, and the flow does not branch from step S20 to step S25 in FIG. 7. Therefore, the repetition flag DUB is kept to be "0". If DUB=1 is not established in step S27 in FIG. 7, the flow returns to step S24 regardless of the judgement result in step S22, and the processing described in Sub-section "Basic Operation" is executed. Note that the repetition flag DUB is initialized to 0 in the processing of step S04 in STEP 0 in FIG. 5.

In a second case, step S22 in FIG. 7 cannot be established when repetition of waveforms described above occurs. This case will be explained below with reference to FIG. 14C.

Figure 14C:
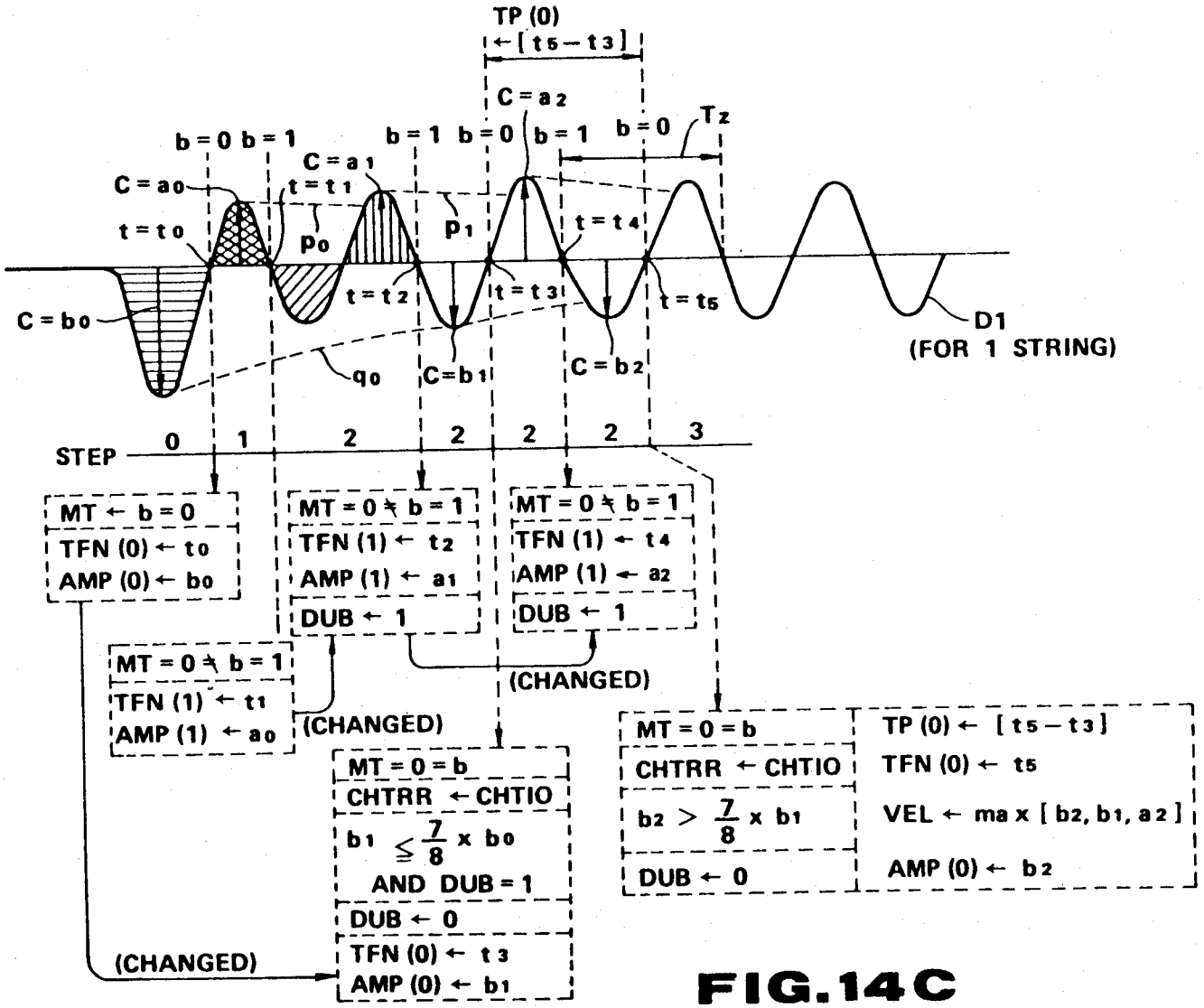

As shown in FIG. 14C, the repetition processing is performed at $t=t_2$ after the processing of STEP 0 ($t=t_0$) and STEP 1 ($t=t_1$), and the peak $c=a_0$ (cross-hatched peak in FIG. 14C) is removed while the peak $c=a_1$ (vertically hatched peak in FIG. 14C) is left, in the same manner as has been described in FIG. 14B. Note that the simple-hatched peak ($c=a_1$) is not originally detected as in FIG. 14A or 14B.

When the repetition occurs as described above, since the positive/negative flag becomes $b=0$ at the next $t=t_3$, as shown in FIG. 14C, it coincides with the flag MT=0 set in STEP 0. Therefore, the flow advances from step S20 to the processing in step S22 via step S21 in FIG. 7. However, the present minimum peak value $c=b_1$ detected at $t=t_3$ is much smaller than the old minimum peak value AMP(0) having the same sign due to repetition of the waveforms, and is largely attenuated. Therefore, as shown in FIG. 14C, NO may be obtained in step S22 in FIG. 7.

In this case, since the repetition processing is performed at $t=t_2$, the value of the repetition flag DUB is "1". Therefore, NO is obtained in step S27 in FIG. 7, and the flow advances to step S29 via step S28 (to be described later).

In step S29, in order to restart processing by acquiring a normal waveform after $t=t_3$ in FIG. 14C, the contents of the old zero-cross time data TFN(0) and the negative old peak value AMP(0) set in STEP 0 are updated to the present zero-cross time t and the present peak value c in step S29 in FIG. 7. More specifically, in FIG 14C, $TFN(0)=t=t_3$ and $AMP(0)=c=b_1$. As a result, the horizontally hatched peak ($c=b_0$) in FIG. 14C is ignored. For the following processing, the repetition flag DUB is reset to "0" in step S28 in FIG. 7. After the above-mentioned operations, the content of the register STEP is not updated, and the flow returns to the processing in step M2 of the main routine in FIG. 4 to wait for the next peak input.

In the above case, as shown in FIG. 14C, STEP 2 in FIG. 7 is repeated at $t=t_4$ and $t=t_5$, and the control then transits to STEP 3. The repetitive operation of STEP 2 described above includes various patterns, and a detailed description thereof will be omitted. A normal waveform can be acquired as the entire control flow, and an operation is performed to effectively determine the data TFN(0), AMP(0), TFN(1), and AMP(1) used for next STEP 3. Thereafter, the control transits to STEP 3.

Note that in the case shown in FIG. 14C, $TP(0)=t_5-t_3$, and the start point of the next period data $T_2$ calculated in STEP 3 (to be described later) corresponds to $TFN(1)=t_4$.

(Processing Operation in STEP 3)

Figure 8:
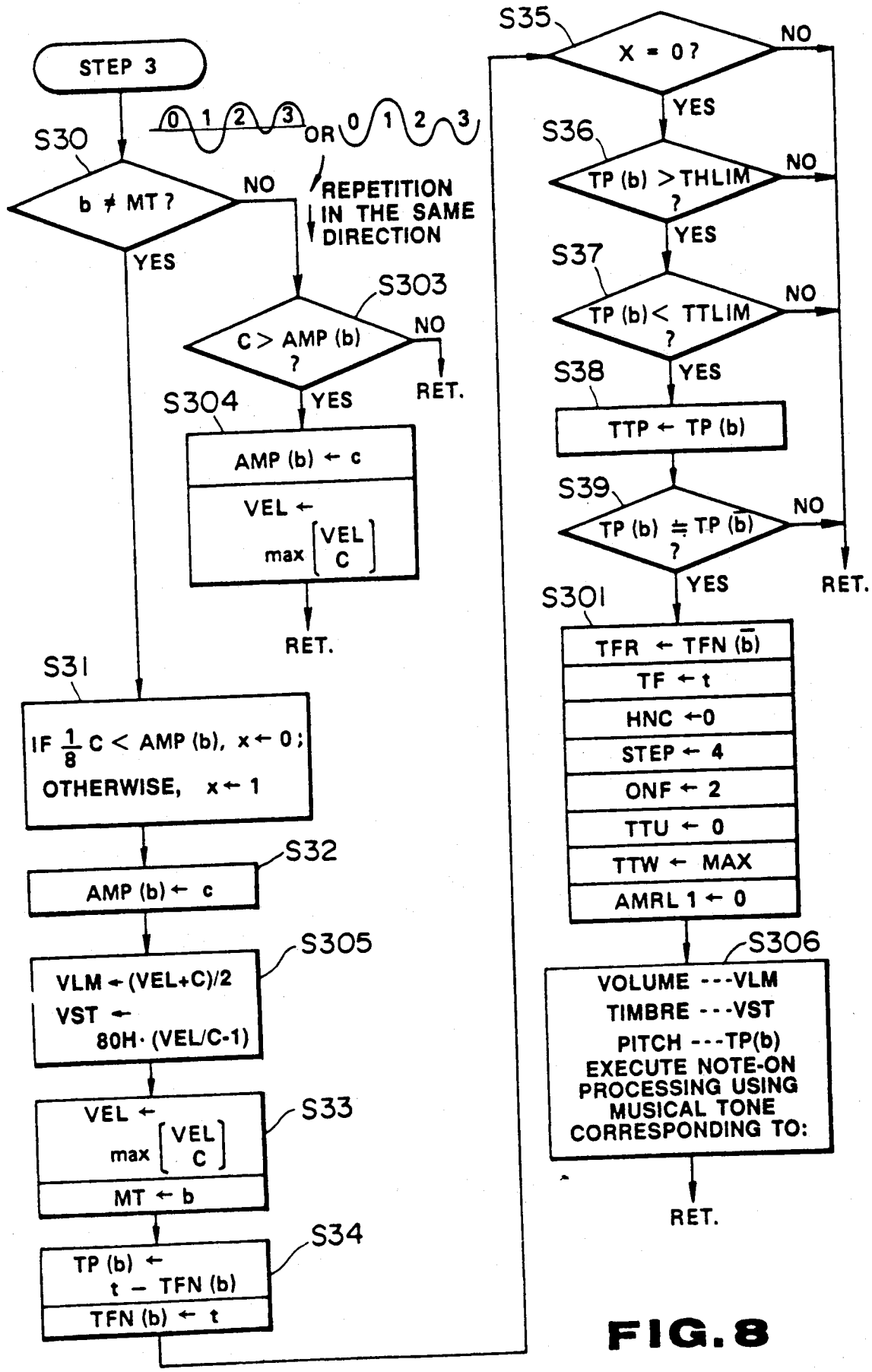
FIG. 8 is an operation flow chart of STEP 3.

FIG. 8 is an operation flow chart of processing in STEP 3 as step M8 in the main routine of FIG. 4. In this processing, note-on (tone generation start) processing, extraction of a pitch period for setting a pitch for note-on operation, calculations of tone volume and tone color parameters, transition processing to STEP 4, error processing when an abnormal waveform is input, and the like are executed.

<Basic Operation>

After the processing in STEP 2 is executed, the main routine shown in FIG. 4 waits for next data input to the registers T0, C, and B upon interruption again from the pitch extraction digital circuit 2 (FIG. 1) by repeating the loop of step M2+M10+M11+M2.

When data are input and the contents of the registers are read in step M3 in FIG. 4, the flow advances to step M8, i.e., STEP 3 in FIG. 8 via step M4. In this state, as shown in FIG. 12, the present zero-cross time $t=t_3$, the present positive/negative flag $b=1$, and the present peak value is the maximum peak value $c=a_1$ since $b=1$.

Note that after steps S30, S31, and S32 in FIG. 8 (to be described later), a tone volume parameter VLM and a tone color parameter VST are calculated in step S305. A largest one of the three previous peak values ($b_0$, $a_0$, and $b_1$ (absolute values) in FIG. 12) is stored as the velocity VEL in step S24 in FIG. 7, as has been described in Sub-section "Basic Operation" in Section "Processing Operation in STEP 2". In step S305 in FIG. 8, an average value $(VEL+c)/2$ of the velocity VEL and the present peak value c is calculated, and is determined as the tone volume parameter VLM used when the musical tone generator 501 (FIG. 1) generates a musical tone. In FIG. 12, since $VEL=a_0$ and $c=a_1$, $VLM=(a_0+a_1)/2$.

Similarly, in step S305 in FIG. 8, a ratio VEL/c of the velocity VEL and the present peak value c is calculated, and 1 is subtracted from the ratio to yield a value between 0 and 1. The difference is multiplied with 80H (H indicates the hexadecimal notation) to yield a value between 0 and 128. The product is determines as the timbre parameter VST used when a timbre of a musical tone is determined. That is, $VST=80H\cdot(VEL/c-1)$. In FIG. 12, $VST=80H\cdot(a_0/a_1-1)$.

After the above operation, the flow advances to step S34 via step S33 in FIG. 8 (to be described later). In step S34, {(present zero-cross time t)−(old zero-cross time data TFN(b) having the same sign)} is calculated to detect a pitch period, and the detected period is set as old period data TP(b). In FIG. 12, $TP(1)=t_3-t_1$.

After steps S35 to S38 in FIG. 8 (to be described later), it is checked in step S39 if the old period data TP(b) calculated in step S34 is substantially equal to the old period data $TP(\bar{b})$ having the different polarity set in step S24 in FIG. 7. If YES in step S39, since it can be determined that the pitch period can be started to be stably extracted, note-on processing is executed in step S306 via step S301 (to be described later). In FIG. 12, it is determined that the negative old period data $TP(1)=t_3-t_1$ is substantially equal to the positive old period data $TP(0)=t_2-t_0$, and the control transits to the note-on processing. Note that a case wherein NO is obtained in step S39 will be described later.

In step S306, corresponding tone volume data, timbre data, and tone pitch data are generated on the basis of the tone volume parameter VLM and the timbre parameter VST calculated in step S305 in FIG. 8 and the old pitch period TP(b) extracted in step S34, and are output to the musical tone generator 501 through the MIDI-BUS and the interface MIDI shown in FIG. 1. The generator 501 generates a musical tone having a tone volume, timbre, and tone pitch corresponding to the input data in real time. In this manner, in this embodiment, the timbre data is extracted as well as the tone pitch data and the tone volume data, and a great performance effect can be obtained, as has been described in Section "General Operation of This Embodiment". In this case, since note-on operation is performed in about 1.5 periods after the waveform rises, as indicated at $t=t_3$ in FIG. 12, a musical tone can be generated to satisfactorily follow the vibration waveform of a string.

Simultaneously with the note-on processing, parameters used in STEP 4 next are set in steps S38 and S301 in FIG. 8, and the flow returns to the processing in step M2 of the main routine shown in FIG. 4. Thus, the control transits to the next STEP 4. More specifically, in step S38, the old period data TP(b) extracted in step S34 is set as the previously extracted period data TTP. In step S301, the old zero-cross time data TFN(b) set in step S24 in STEP 2 is set in the time storing register TFR, the present zero-cross time data t is set as valid old zero-cross time data TF, a waveform number counter HNC is cleared to "0", the value of the register STEP is updated to "4", the note-on flag ONF is set to be "2" (sound generation state), the constant TTU is set to be "0" (minimum MIN), the constant TTW is set to be maximum MAX, and the old amplitude value AMRL1 for relative-off check is cleared to "0". These parameters will be described later in STEP 4.

<Operation When Period is Inappropriate>

When the old period data TP(b) is detected in step S34 in FIG. 8, the pitch period must be longer than a period when the corresponding string is plucked at its highest fret, and shorter than the open string period of the string.

As the constant, i.e., the upper limit frequency THLIM, a period of a pitch higher by 2 to 3 halftones than a pitch determined by the highest tone fret of a string which is presently subjected to processing, and as the constant, i.e., the lower limit frequency TTLIM, a period of a pitch lower by 5 halftones or more than a pitch determined by the open string state of the identical string is set. In steps S36 and S37 in FIG. 8, it is checked if the old period data TP(b) calculated in step S34 is larger than THLIM and is smaller than TTLIM. If YES is obtained in both steps S36 and S37, the flow advances to step S39, and the period judgement processing described above is performed.

If NO in step S36 or S37, it is determined that the old period data TP(b) extracted in step S34 is inappropriate. Therefore, in this case, the flow returns from step S36 or S37 to the processing in step M2 in the main routine of FIG. 4, and STEP 3 is repeated.

If it is determined in step S39 in FIG. 8 that the old period data TP(b) calculated in step S34 is different from the old period data TP(b) having the different polarity, an overtone or the like may be accidentally extracted and an accurate pitch period fails to obtain. In this case, the pitch period cannot be stably extracted. Therefore, NO is obtained in step S39, and the flow returns to the processing in step M2 in the main routine of FIG. 4 to repeat STEP 3.

When STEP 3 is repeated with the above operations, in a normal waveform, the polarities of a newly detected peak via steps M2 and M3 in FIG. 4 are alternately switched, and the value b is alternately inverted to be 0 and 1. In addition, in step S33 in FIG. 8, the value of the flag MT is alternately updated, and in step S34, new TP(b) is calculated and the content of TFN(b) is updated. Therefore, judgement in steps S36 and S37 is performed for the latest pitch period, and judgement in step S39 is performed for the latest pitch period and second latest pitch period (before about half a period) having the opposite polarity. When the pitch periods can be stably extracted, the control transits to the note-on processing.

In steps S305 and S33 in FIG. 8, the tone volume parameter VLM, the timbre parameter VST, and the velocity VEL are updated accordingly in correspondence with the newly detected peak.

<Operation of Noise Removal Processing>

Figure 15:
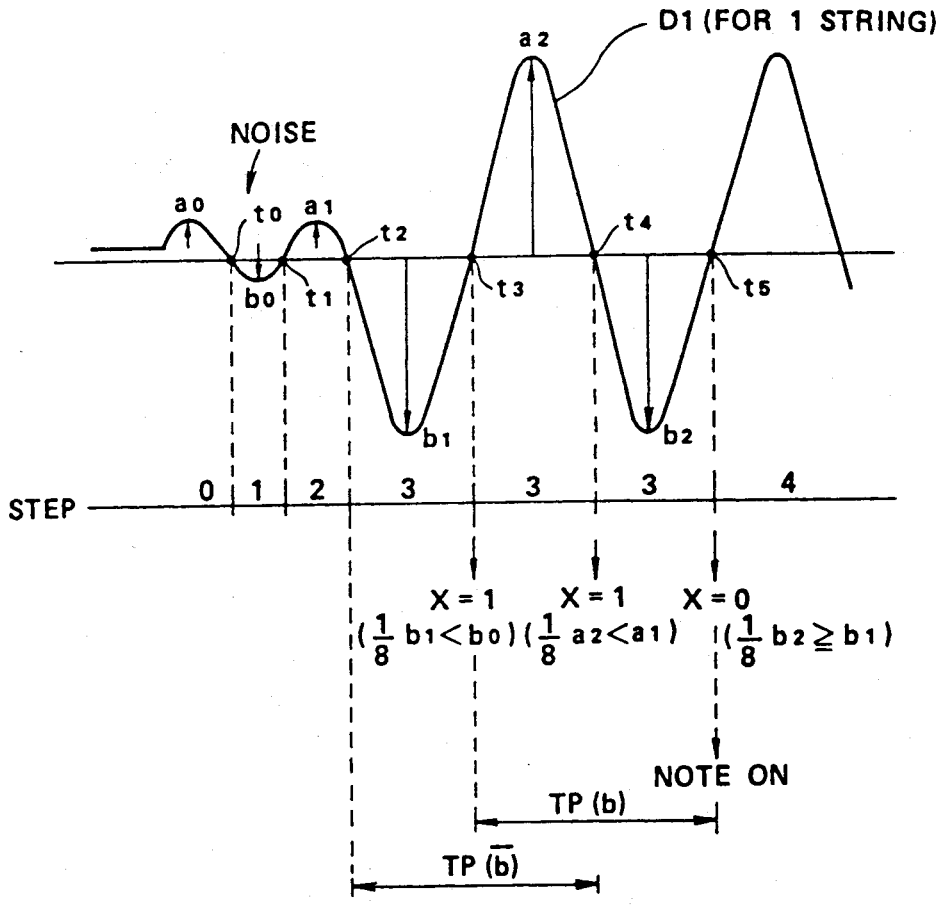
FIG. 15 is a chart for explaining noise removal processing in STEP 3.

The processing in step S31 in FIG. 8 is performed to cope with a case wherein a noise component appears in the leading edge portion of the waveform. Assume that peaks $a_0$, $b_1$, $a_1$, and the like caused by noise are accidentally detected in STEPs 0, 1, and 2, as shown in FIG. 15. If the periods of these noise components are detected and tone generation start is instructed, a quite unnatural musical tone is generated.

In step S31 in FIG. 8, when successive peak values are largely changed, it is determined that a noise component is generated, and the abnormal detection flag X is set to be "1". Thus, NO is obtained in step S35 so as to prevent note-on processing on the basis of the noise portion.

More specifically, normality is determined if a $\frac{1}{8}$ value of the present peak value c is smaller than the old peak value AMP(b) having the same sign, and the flag X is set to be "0"; otherwise, X=1 is set. If it is determined in step S35 that X=0, the flow returns to the processing in step M2 in the main routine of FIG. 4 to repeat STEP 3. In this case, since the old peak value AMP(b) is sequentially updated in step S32 in FIG. 8, the processing in step S31 is performed for the latest peak value and the immediately preceding peak value having the same sign. When the successive peak values are free from a large change, the control transits to the note-on processing. In FIG. 15, both at $t=t_3$ and $t=t_4$, X=1 is determined in step S31. Therefore, the note-on processing is not performed. At $t=t_5$, since it is determined that a normal peak is input for the first time, X=0 is determined in step S31, and the note-on processing is performed at $t=t_5$. In this case, the successive pitch periods TP(b) and TP(b) have normal values.

<Operation of Repetition Processing>

The judgement processing in step S30 in FIG. 8 is performed for repetition processing. If the normal waveform D1 as shown in FIG. 12 is input, the present positive/negative flag b=1 at $t=t_3$ does not coincide with the flag MT=0, and the flow advances to step S31, as described above.

However, as has been described in Sub-section "Operation of Repetition Processing" in Section "Processing Operation in STEP 1" or "Processing Operation in STEP 2", when the waveforms are repetitively input, NO is obtained in step S30.

When the repeating peak value c is smaller than the old peak value AMP(b) having the same sign, NO is obtained in step S303 in FIG. 8, and the repeating peak is ignored. Thereafter, the flow returns to the processing in step M2 in FIG. 4 to repeat STEP 3, based on the same consideration as in FIG. 14A and the like.

In contrast to this, if the repeating peak value c is larger, YES is obtained in step S303, and the flow advances to the processing in step S304. In step S304, the old peak value is ignored. The content of the AMP(b) is updated to the present peak value c, and the velocity VEL is calculated again using the updated value. Thereafter, the flow returns to step M2 in FIG. 4 to repeat STEP 3, based on the same consideration as in FIG. 14B and the like.

When the normal peak is input after the above-mentioned processing, YES is obtained in step S30, and YES is obtained in steps S35, S36, S37, and S39. Thus, the note-on processing is performed, and generation of a musical tone is started.

(Processing Operation in STEP 4)

Figure 9:
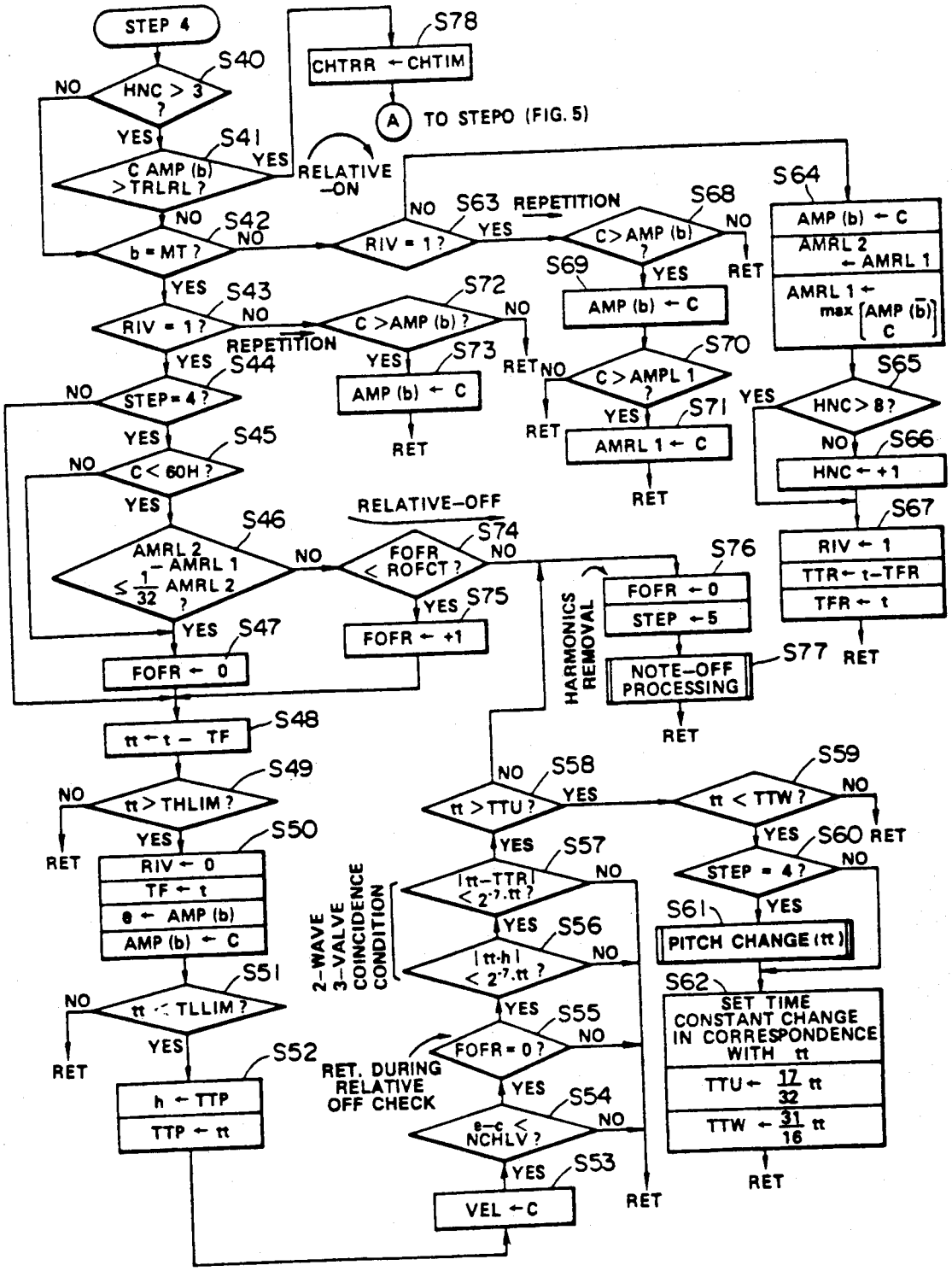
FIG. 9 is an operation flow chart of STEP 4 or 5.

FIG. 9 is an operation flow chart of processing in STEP 4 as step M9 in FIG. 4. In this processing, pitch extraction/change processing, relative-on/relative-off processing, processing when a pitch period is inappropriate, repetition processing, and the like are performed. This processing is not directly related to the present invention but is important for tone pitch control of a musical tone. Thus, this processing will be described below. The pitch extraction/change processing includes a route ① for performing only pitch extraction and a route ② for actually changing a pitch, and generally these routes are alternately repeated every time a new peak is input.

{Operation of Pitch Extraction Processing (Route ①)}

The route ① shown in steps S40, S41, S42, and S63 to S67 will be described first. In step S40, whether or not the waveform number counter HNC>3 is checked. If YES in step S40, the flow advances to step S41. It is checked in step S41 if the relative-on threshold value TRLRL<(present peak value c−old peak value AMP(b) having the same sign). If NO in step S41, the flow advances to step S42 (a case of YES will be described later). It is then checked in step S42 if the present positive/negative flag b=flag MT, i.e., a pitch is to be changed. If YES in step S42, the flow advances to step S43.

However, in an initial state, the content of the waveform number counter HNC is 0 (see step S301 in FIG. 8). Thus, NO is obtained in step S40, and the flow advances to step S42. For example, when the waveform as shown in FIG. 12 is input, since b=0 and MT=1 (which latter is written in step S33 in STEP 3 in FIG. 8) at $t=t_4$, the flow advances from step S42 to step S63.

It is checked in step S63 if the register RIV=1 in order to check whether or not the peaks having the same polarity are repetitively input (repetition is detected). If YES in step S63 (peaks having the same polarity are repetitively input), the flow advances to step S68 to perform repetition processing (to be described later). If NO in step S63 (repetition is not detected), the flow advances to step S64, and the following processing is executed.

In step S64, the present peak value c is input as the old peak value AMP(b), and the old amplitude value AMRL1 is input as the amplitude value AMRL2 immediately preceding the old amplitude value AMRL1 for relative-off processing (to be described later). Note that the content of AMRL1 is initially set to be "0" (step S301 in STEP 3 in FIG. 8).

Furthermore, a larger one of the old and present peak values AMP(b) and c having opposite signs is input as the old amplitude value AMRL1. More specifically, a larger one of the two, i.e., positive and negative peak values in a period is set in the amplitude value AMRL1.

It is checked in step S65 if the waveform number counter HNC>8. The waveform number counter (zero-cross counter not at a pitch change side) HNC is incremented by 1. Therefore, the upper limit of the waveform number counter HNC is 9. After the processing in step S65 or S66, the flow advances to step S67. In step S67, the register RIV is set to be "1", the content of the time storing register TFR is subtracted from the present zero-cross time t, and the difference is input to the period register TTR. The period register TTR indicates the period data $TTR=t-TFR=t_4-t_2$ in FIG. 12. The present zero-cross time t is saved in the time storing register TFR, and thereafter, the flow returns to the processing in step M2 in the main routine of FIG. 4.

As described above, in the route ①, the following processing is executed according to FIG. 12. More specifically, $MT=1=b$, $RIV=0$, $AMP(0)+c=b_2$, $AMRL2 \leftarrow AMRL1=0$, $AMRL1 \leftarrow \max\{AMP(1)=a_1, c=b_2$ (a larger one of them)$\}$, $HNC+(HNC+1)=1$, $RIV \leftarrow 1$, $TTR \leftarrow \{t-TFR\}=\{t_4-t_2\}$, and $TFR \leftarrow t=t_4$. Therefore, a time data difference of time data from the old zero-cross time $t=t_2$ (change point from STEP 2+STEP 3) to the present zero-cross time $t=t_4$, i.e., period data is set in the period register TTR. The flow then returns to the processing in step M2 in the main routine of FIG. 4 to wait for the next peak input.

<Operation of Pitch Change Processing (Route ②)>

A case will be described below wherein the control advances to the route 2 shown in steps S40 to S62. Since the waveform number counter HNC=1 (step S66), the flow advances from step S40 to step S42 (step S40 will be described later).

YES is obtained in step S42 since MT=1 and b=1 in FIG. 12, and the flow advances to step S43.

It is checked in step S43 if the register RIV=1. Since the register RIV has already been set to be "1" in the route ① (step S67), YES is obtained in step S43, and the flow advances to step S44. Repetition processing performed when NO is obtained in step S43 will be described later.

It is checked in step S44 if the register STEP=4. If YES in step S44, the flow advances to step S45 (a case of NO will be described later). It is checked step S45 if the present peak value c<60H (H indicates the hexadecimal notation). If a large peak value is input, NO is obtained in step S45, and the flow advances to step S47. Contrary to this, when the input value is smaller than 60H, YES is obtained in step S45, and the flow advances to step S46.

In step S46, it is checked if {the amplitude value (peak value) A1RL2 before A1RL1}−{the old amplitude value (peak value) AMRL1}≦(1/32)×{the amplitude value (peak value) AMRL2 before AMRL1}. If YES in step S46, the flow advances to step S47, and the relative-off counter FOFR is set to be "0". If NO in step S46, the flow advances to step S74, and relative-off processing is executed. The relative-off processing will be described later.

In step S48, a period calculation is made. More specifically, (present zero-cross time t−old zero-cross time data TF) is set in the register TOTO as present period value tt. The flow then advances to step S49.

In step S49, it is checked if the present period data tt>upper limit frequency THLIM (upper limit after tone generation start). If YES in step S49, the flow advances to step S50 (a case of NO will be described later). The upper limit frequency THLIM in step S49 is the same as the upper limit of the allowable range of the frequency (i.e., corresponding to a minimum period of a tone, pitch of which is higher by 2 to 3 halftones than that of a highest tone fret) upon triggering (starting of tone generation) used in step S36 in STEP 3 in FIG. 8.

In step S50, the following processing is executed. More specifically, the register RIV is set to be "0", the present zero-cross time t is input as the old zero-cross time data TF, the old peak value AMP(b) is input as the peak value e before the old peak value AMP(b), value AMP(b).

After the processing in step S50, the flow advances to step S51 to check if the lower limit frequency TLLIM>the present period data tt. If YES in step S51, i.e., if the value of the present period becomes smaller than the value of the lower limit pitch extraction tone range during note-on (sound generation), the flow advances to step S52. In this case, the lower limit frequency TLLIM is set to be a value lower by one octave than that of an open string note. More specifically, the allowable range is widened as compared to the lower limit frequency TTLIM (step S37) in STEP 3 shown in FIG. 8. Thus, a change in frequency upon operation of a tremolo arm can be coped with.

With the above operation, when the present period falls within the range defined by the upper and lower limit frequencies, the flow advances to step S52; otherwise, the flow returns from step S49 or S51 to the processing in step M2 in the main routine shown in FIG. 4 to w it for the next peak input.

In step S52, the period data TTP is input as period data h extracted before the old period, and the present period data tt is input as the previously extracted period data TTP.

In step S53, the present peak value c is written as the velocity VEL, and the flow advances to step S54.

It is checked in step S54 if the no-change level NCHLV>(the peak value e before the old peak value the present peak value c). If YES in step S54, the flow advances to step S55. More specifically, if the old peak value (e=AMP(b)) having the same polarity and the present peak value c are largely changed, a difference therebetween exceeds NCHLV. In this case, if a pitch is changed on the basis of the extracted period data, an unnatural change in tone pitch may occur. Thus, if NO is obtained in step S54, the flow returns to the processing in step M2 in the main routine of FIG. 4 without executing the processing in step S55 and the subsequent steps, thus waiting for the next peak input.

If YES in step S54, it is checked in step S55 if the relative-off counter FOFR=0. If relative-off processing (to be described later) is performed, the relative-off counter FOFR is not "0". In this case, NO is determined in step S55 without executing pitch change processing (see step S61), and the flow returns to the processing in step M2 in the main routine of FIG. 4. If YES in step S55, the flow advances to steps S56 and S57.

In steps S56 and S57, a "2-wave 3-value coincidence condition" is checked. In step S56, whether or not the present period data $tt\times2^{-7}>|$the present period data tt−period data h before the old period data$|$ is checked. If YES in step S56, the flow advances to step S57. In step S57, whether or not the present period data $tt\times2^{-7}>|$the present period data tt−content of the period register TTR$|$ is checked. If YES in step S57, the flow advances to step S58. More specifically, for the case shown in FIG. 12, it is checked in step S56 if the present period data $tt=t5-t3$ (step S48) is almost equal to the old period data $h=TTP=t_3-t_1$ (step S52), and it is checked in step S57 if the present period data $tt=t_5-t_3$ is almost equal to the period $TTR=t_4-t_2$ (step S67) partially overlapping it. Note that its limit range is determined as $2^{-7}\cdot tt$, and its value is changed depending on period data. Of course, although the limit range may be fixed, a better result can be obtained when this embodiment is employed.

It is checked in step S58 if the present period data tt > the constant TTU. If YES in step S58, the flow advances to step S59 to check if the present period data tt < the constant TTW. If YES in step S59 flow advances to step S60. A case wherein NO is obtained in step S58 or S59 will be described later.

It is checked in step S60 if the register STEP=4. If YES in step S60, the flow advances to step S61.

In step S61, the MCP 3 shown in FIG. 1 instructs the musical tone generator 501 to change a pitch (based on the present period data tt), and the flow advances to step S62.

In step S62, the time constant is changed in correspondence with the present period data tt, the constant TTU is rewritten to (17/32)×the present period data tt, and the constant TTW is rewritten to (31/16)×the present period data tt.

As will be described later, only when the relative-off processing is performed, STEP=5 is established. In this case, the flow directly advances from step S60 to step S62. Thus, the time constant is changed in step S62 without changing a pitch in step S61.

The time constant change processing means that the MCP 3 shown in FIG. 1 sets period data based on the value of the present period data tt in the time constant conversion register CHTRR in the time constant conversion controller 202 shown in FIG. 2. This processing is performed as has been described in Sub-section "Detailed Operation" in Section "Operation of Pitch Extraction Digital Circuit".

Upon completion of the processing in step S62, the flow returns to the processing in step M2 of the main routine shown in FIG. 4.

In the above-mentioned route ②, the following processing is executed in the case of FIG. 12. More specifically, it is determined that HNC=1, MT=1=b, and RIV=1. Operations FOFR←0, $tt\leftarrow t-TF=t_5-t_3$, RIV←0, $TF\leftarrow t=t_5$, $e\leftarrow AMP(1)=a_1$, $AMP(1)\leftarrow c=a_2$, $h\leftarrow TTP=TP(1)=t_3-t_1$, $TTP+tt=t_5-t_3$, and $VEL\leftarrow c\triangleq a_2$ are performed. Furthermore, a pitch is changed in accordance with tt when the following three conditions are satisfied:

① TTP=TTR=tt
② TTU<tt<TTW
③ AMP(0)−c<NCHLV

Thereafter, TTU←(17/32)×tt and TTW←(31/16)×tt are set.

With the above-mentioned operations, in the route ②, actual pitch change processing for the musical tone generator 501 (FIG. 1) is performed. Thereafter, the processing of the route ① is executed upon the next zero-cross interruption (detection of the next peak), and similarly, the processing in the route ② is executed upon the next zero-cross interruption. In this manner, in the route ①, only a period is extracted (step S67), and in the route ②, actual pitch change processing (step S61) and time constant change processing (step S62) are executed.

<Relative-On Processing Operation>

After the waveform number counter HNC is counted up to exceed 3 in step S66 in the route ① in STEP 4 in FIG. 9, YES is determined in step S40, and the flow advances to step S41 to detect a "relative-on condition".

This case occurs when c−AMP(b)>TRLRL, i.e., the present peak value c is increased to exceed the threshold value TRLRL as compared to the old peak value AMP(b). That is, when a given string is plucked immediately after it was plucked (by, e.g., tremolo operation). In this case, YES is obtained in step S41, and the flow advances from step S41 to step S78 to execute the relative-on processing.

In step S78, the period CHTIM of the highest note fret (e.g., 22nd fret) is set in the time constant conversion register of the time constant conversion controller 202 (FIG. 2).

After the above processing, the flow advances to step S06 in STEP 0 in FIG. 5, a musical tone which is being produced is rendered note-off, and its tone generation is restarted. According to a normal performance operation, NO is determined in step S41 in STEP 4 in FIG. 9, and the flow advances to step S42. Thereafter, the control advances to the route ① or ②.

<Relative-Off/ Processing Operation>

Figure 16:
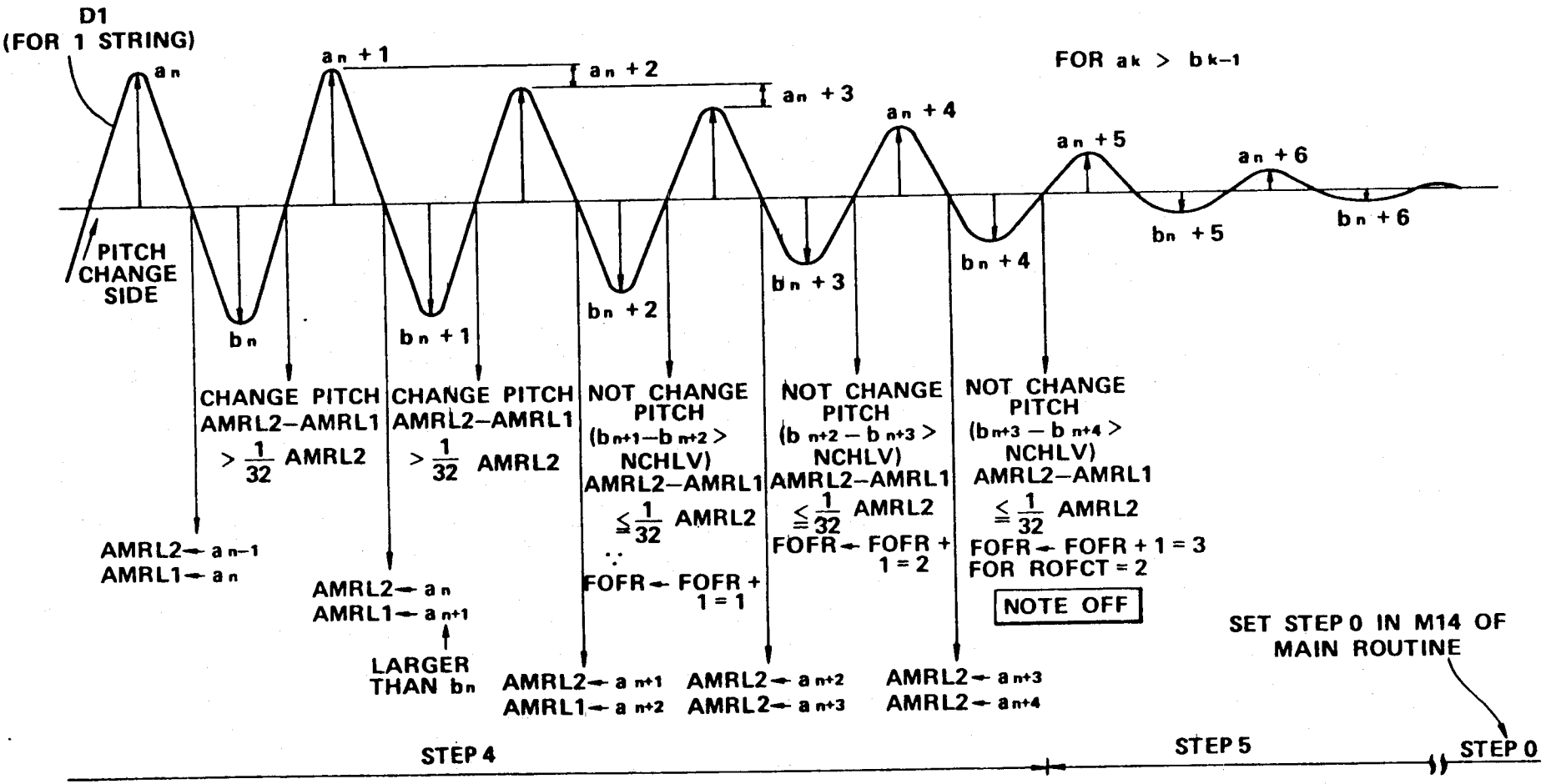
FIG. 16 is a chart for explaining relative-off processing in STEP 4.

Relative-off processing will be described below with reference to FIG. 16. In "relative-off" processing, a note-off operation is performed when a state wherein the fret operation is performed transits to an open string state without plucking the corresponding string.

In this case, the amplitude level of the waveform immediately falls, and a difference between the peak value A1RL2 before the old peak value and the old peak value AMRL1 exceeds (1/32)·AMRL2. Thus, the flow advances from step S46 to step S74 in FIG. 9.

The flow then advances from step S74 to step S75 until the relative-off counter FOFR is counted up beyond the constant ROFCT.

Subsequently, the flow advances from step S75 to step S48 and processing in steps S49 to S55 is executed. However, since FOFR=0, NO is obtained in step S55, and the flow returns to the processing in step M2 in the main routine of FIG. 4 without performing pitch change processing immediate before the relative-off processing.

Peaks in a relative-off state are sequentially input, and NO is obtained in step S74. That is, if the value of the counter FOFR becomes 3 in FIG. 16 (ROFCT=2), the flow advances from step S74 to step S76.

Once YES is obtained in step S46, the flow advances from step S46 to step S47, and the counter FOFR is reset. Therefore, unless the condition in step S46 is kept satisfied a number of times designated by the constant ROFCT, the relative-off processing is not executed. Note that as the value ROFCT, a larger value is assigned to a string having a higher pitch, so that relative-off processing can be performed for any string after the lapse of an almost predetermined period of time.

The flow then advances from step S74 to step S76, In step S76, the relative-off counter FOFR is reset, and the register STEP is set to be 5. The flow advances to step S77, and the musical tone generator 501 (FIG. 1) is instructed to perform note-off.

When the register STEP=5, the pitch extraction processing is executed in the same manner as in STEP 4. However, since the flow advances from step S60 to step S62 without going through step S61, the musical tone generator 501 is not instructed to change a pitch. However, the MCP3 performs the time constant change processing in accordance with the period extracted in step S62.

When the register STEP=5, the relative-on processing is accepted (S41 and S78). In other cases, since a decrease in vibration level is detected in the main routine shown in FIG. 4, the register STEP is set to be "0" in step M14, and an initial state is set.

Note that AMRL1 and AMRL2 used in step S46 are formed in step S64, and a peak (one of maximum and minimum peaks) having a higher level in a period is determined as this value. A maximum peak ak in FIG. 16 is always higher than a minimum peak bk-1, and all differences between an+1 and an+2, an+2, and an+3, and an+4 exceed a predetermined value.

In the processing of the route ②, since the minimum peaks bn+1, bn+2, and bn+3 are extremely decreased, NO is achieved in step S54. The flow then returns to the processing in step M2 of the main routine shown in FIG. 4, and the pitch change processing is not executed.

<Processing Operation When Pitch Period is Inappropriate>

Processing when a pitch period is inappropriate, that is, when overtones in an octave relationship, i.e., periods having tone pitches higher or lower by an octave are successively detected in steps S58 and S59 during pitch extraction will be described below.

The constant TTU used in step S58 in STEP 4 of FIG. 9 is set to be a minimum value "0" in step S301 in STEP 3 of FIG. 8, and the constant TTW is similarly set to be a maximum value MAX. When this flow is executed for the first time, YES is always determined in both steps S58 and S59. Thereafter, in step S62, (17/32)·tt (period data having a tone pitch higher by almost one octave) is set as the constant TTU, and similarly, (31/16)·tt (period data having a tone pitch lower by almost one octave) is set as the constant TTW.

Therefore, When the tone pitch is immediately increased by an octave (this is caused when a mute operation is performed to stop a vibration of a string with a finger) or when the tone pitch is immediately decreased by an octave (this is caused when the peak of the waveform fails to detect), if a pitch is changed, the resultant tone sounds unnatural. Thus, the flow branches so as not to execute pitch change processing.

More specifically, if tt does not exceed TTU, i.e., tt becomes smaller than the value TTU obtained by multiplying 17/32 with the previously extracted period in step S58, the flow advances to step S76. When a tone higher by an octave is extracted, it is determined that a mute operation is performed, and the flow advances from step S58 to step S76 without outputting a tone higher by an octave, and generation of the corresponding tone is stopped by the processing in steps S76 and S77 in the same manner as in the relative-off processing already explained.

If tt does not exceed TTW, i.e., tt becomes smaller than the value TTW obtained by multiplying 31/16 with the previously extracted period in step S59, the flow returns to the processing in step M2 of the main routine shown in FIG. 4 without advancing to step S60.

Figure 17:
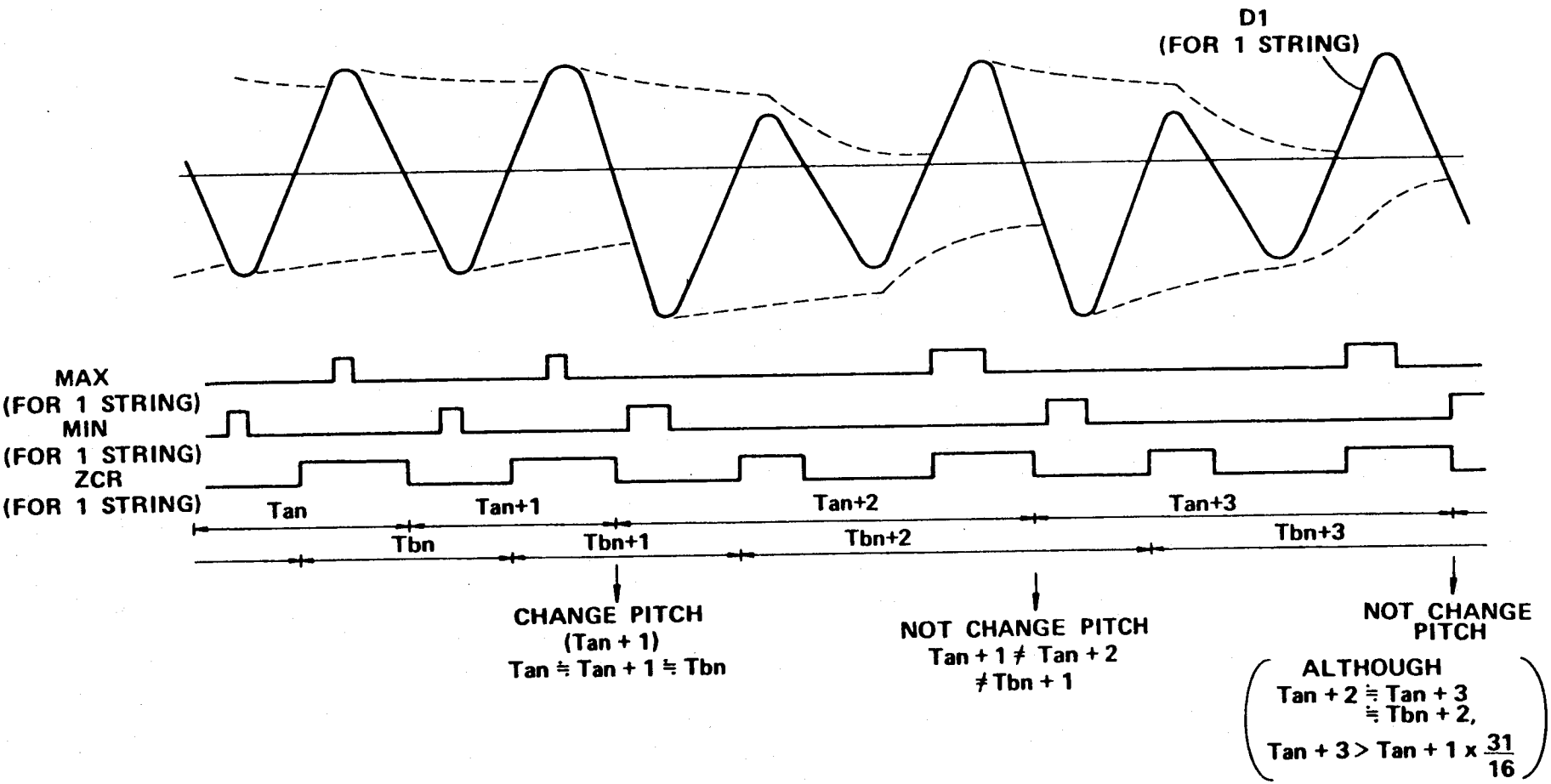
FIG. 17 is a chart for explaining a processing operation when a detected pitch is inappropriate in STEP 4.

This state is shown in FIG. 17. When a waveform near note-off is very small, another waveform is superposed due to a crosstalk of the hexa-pickup or a resonance of a body caused by plucking operation of other strings. Thus, the input waveform becomes as shown in FIG. 17, and an input waveform below one octave may be successively detected.

In this state, if no processing is performed, a tone below one octave is generated, thereby resulting in very unnatural tone generation. For this reason, even if Tan+2=Tan+3=Tbn+2 is detected in steps S56 and S57, since Tan+3>Tan+1×(31/16), the flow returns from step S59 to the processing in step M2 in the main routine shown in FIG. 4 without changing a pitch.

<Repetition Processing Operation>

Processing when waveforms are repetitively extracted, i.e., when peaks having the same polarity are successively detected will now be described.

In the route ① wherein NO is obtained in step S42 in STEP 4 in FIG. 9, if YES is obtained in step S63, the flow advances to step S68 to execute the repetition processing.

More specifically, if YES in step S63, the flow advances to step S68 to check if the present peak value c>the old peak value AMP(b) having the same sign. If YES in step S68, the flow advances to step S69.

In step S69, the old peak value AMP(b) is rewritten to the present peak value c, and the flow advances to step S70.

It is checked in step S70 if the present peak value c>the old amplitude value (peak value) AMRL1. If YES in step S70, the flow advances to step S71. In step S71, the present peak value c is set as the old amplitude value (peak value) AMRL1.

If NO is determined in step S68, the flow immediately returns to the processing in step M2 of the main routine shown in FIG. 4. Therefore, only when the peak of a new input wave is high, it can be determined that the peak of an overtone is not picked up. Therefore, the peak value of the new waveform is registered.

If NO in step S70 and if the processing in step S71 is completed, the control similarly returns to the main routine.

Figure 18:
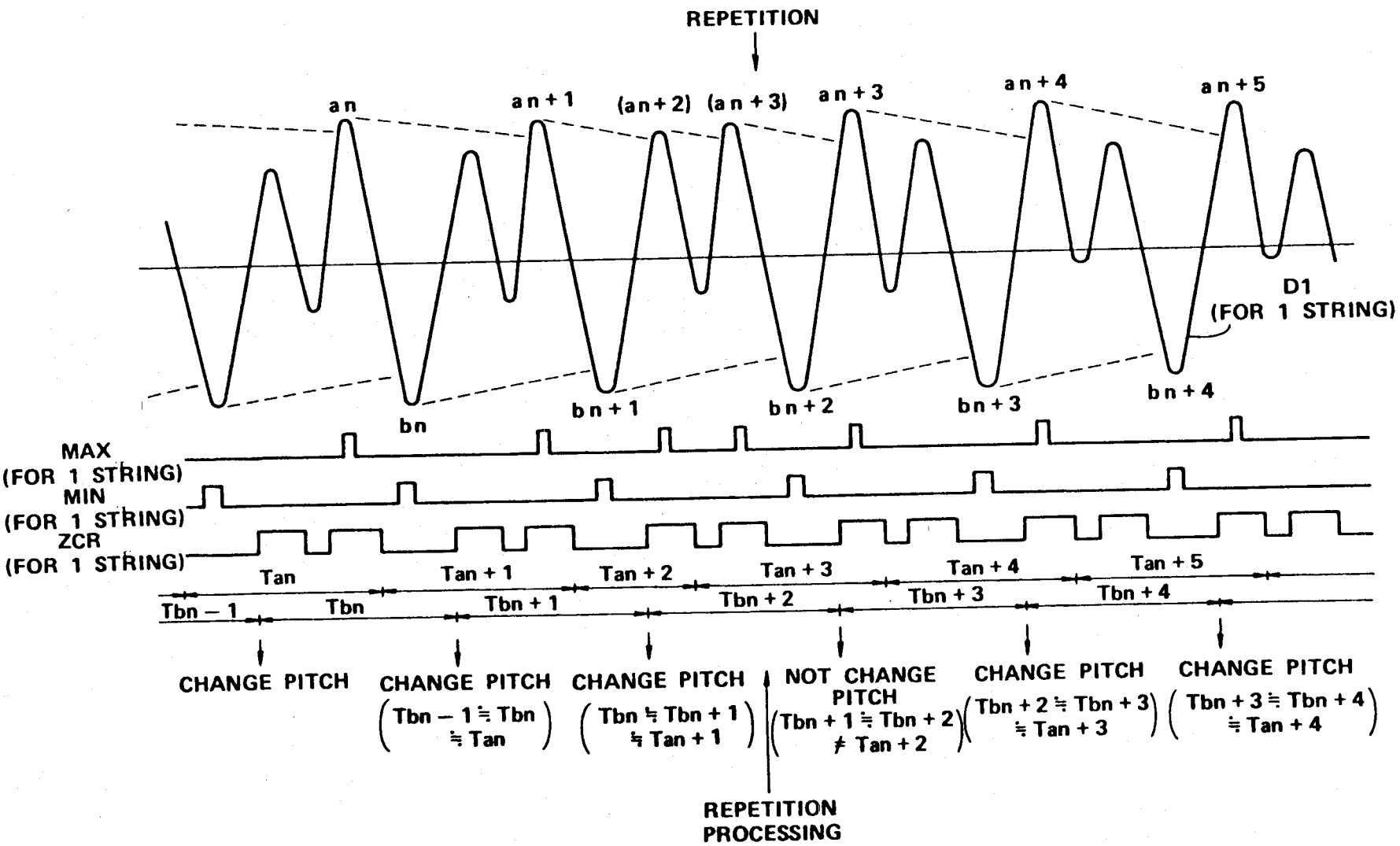
FIG. 18 is a chart for explaining repetition processing in a route①.

FIG. 18 shows the repetition processing. In this case, MT=0. In general, since the fundamental wave period has a non-integer multiple relationship with the period of an overtone component, the phase of the overtone is gradually shifted, and a zero-cross point having the same polarity may be accidentally detected. Therefore, erroneous pitch change processing caused by the above detection must be prevented. In FIG. 18, a repetition state occurs at a position indicated by "repetition". In this case, the flow advances from step S42 to step S63. YES is determined in step S63, and the flow advances to step S68. In this case, (an+2) is compared with (an+3) in step S68. Only when (an+3) is larger than (an+2), the flow advances to step S69, and AMP(1) is updated. The old amplitude value (peak value) AMRL1 is compared with the present amplitude value (peak value c) in step S70. If YES in step S70, the flow advances to step S71, and the present peak value c is set as the old amplitude value (peak value) AMRL1.

In the route ② wherein YES is obtained in step S42 in STEP 4 in FIG. 9, if NO is obtained in step S43, the flow advances to step S72, and the repetition processing is executed in the same manner as described above.

More specifically, if NO in step S43, the flow advances to step S72 to check if the present peak value the old peak value AMP(b) having the same sign. If YES in step S72, the flow advances to step S73, and the old peak value AMP(b) is written to the present peak value c. Thereafter, the flow returns to the processing in step M2 of the main routine shown in FIG. 4.

If NO in step S72, the flow returns to the processing in step M2 of the main routine shown in FIG. 4. In this case, only when the peak of a new input wave is high, the peak value of the new waveform is registered.

Figure 19:
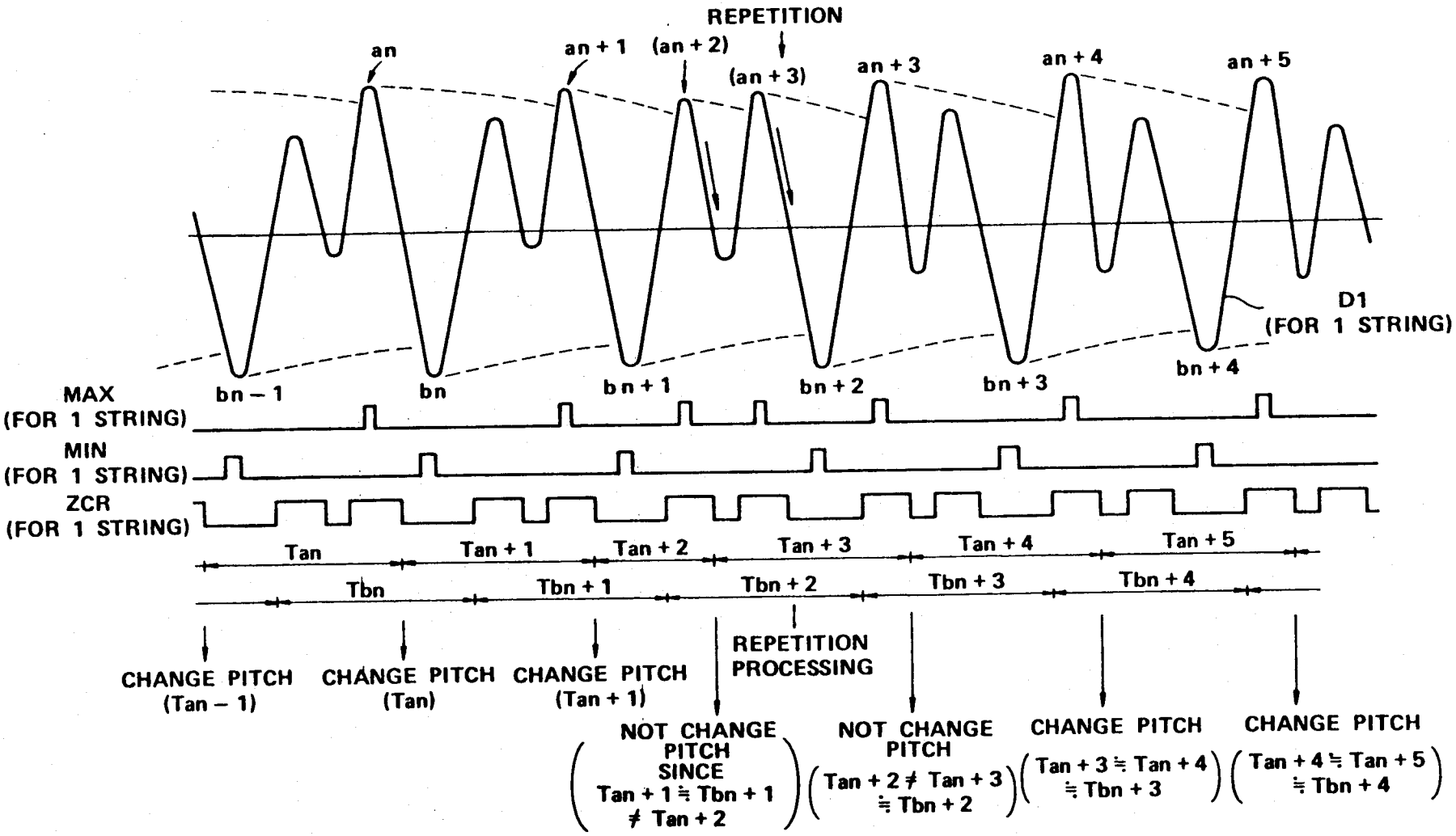
FIG. 19 is a chart for explaining repetition processing in a route②.

FIG. 19 shows this case. In this case, MT=1. In the processing of STEP 4 at the zero-cross point indicated by "repetition", the flow advances from step S42 to step S43. YES is obtained in step S43, and the flow advances to step S72. In this case, (an+3) is compared with (an+2) in step S72. If (an+3) is larger than (an+2), YES is determined in step S72, and (an+3) is set in AMP(1); otherwise, no change processing is executed.

In the repetition processing, extracted time data is not used. Therefore, period data Tan+3 is left unchanged. Pitch change processing based on the period data is not executed, either.

{Other Embodiments of the Present Invention and Advantages of the Present Invention}

As described above, in this embodiment, the tone volume parameter VLM is generated based on the average value of the peak extracted in STEP 3 and the previous maximum peak, and the timbre parameter VST is generated based on the ratio of the above peaks (step S305 in FIG. 8). However, the present invention is not limited to this parameter extraction method. Any other techniques can be employed as long as a signal intensity at the leading edge of a waveform shown in FIG. 11A or 11B and the degree of its change can be quantified. For example, the tone volume parameter VLM can be determined by a maximum peak value until the tone generation start timing, and the timbre parameter can be determined by a difference between the maximum peak value until the tone generation start timing and the next peak value. Further modifications can be done, for example, such parameters can be generated by accessing a predetermined conversion table according to obtained data.

In the above embodiment, the present invention is applied to an electronic guitar (guitar synthesizer). However, the present invention is not limited to this. The present invention can be applied to a different kind of musical tone generating apparatus which detects a performance operation as an input waveform signal and generates an acoustic signal different from an original signal on the basis of the detected waveform signal even in an electronic musical instrument which does not perform pitch extraction to determine the pitch of the tone to be generated.

Furthermore, the two parameters, i.e., the signal intensity and the signal intensity change degree need not always control only the tone volume and timbre of a musical tone. For example,.various sound effects can be independently performed by using the two or more parameters.

As described above, according to the present invention, in an electronic musical instrument or an electric equipment which controls a musical tone generating unit on the basis of an input waveform signal to artificially obtain a corresponding musical tone, a signal intensity and its change degree at the leading edge of the input waveform signal are detected, and the musical tone is controlled based on these parameters, so that at least two musical tone control operations, in particular, a tone volume and a timbre can be independently controlled, thus obtaining an abundant performance effect.

When a metal string vibration of, e.g., an electronic guitar is detected by a pickup to obtain an input waveform signal, and a pitch period is extracted from the waveform to control a tone pitch of a musical tone, and tone volume and timbre control parameters are extracted from a value (average value or largest value and the like) and a ratio or difference of successive peak values at the leading edge to control a musical tone, so that an abundant performance expression can be allowed depending on a string plucking strength and a plucking position, resulting in a great performance effect.

What is claimed is:

1. A control apparatus for an electrical musical instrument, comprising:

input means for receiving from said instrument an input signal which cyclically varies in amplitude;

intensity detection means connected to receive said input signal for detecting intensity values at a leading edge of said input signal by sensing the peak amplitude values thereof;

intensity change detection means connected to receive said sensed peak amplitude values for detecting changes in said intensity values; and a musical tone generating control means for controlling at least two characteristics of a musical tone in accordance with said detected intensity values and said detected changes in intensity values.

2. An apparatus according to claim 1 wherein said apparatus further comprises pitch extraction means for extracting pitch data from said input signal, and wherein said musical tone generating control means include means for controlling the tone pitch of said musical tone.

3. An apparatus according to claim 2, wherein said apparatus further comprises peak detection means for detecting the maximum peak value of said input signal and the next peak value having the same sign as that of the maximum peak value, and wherein said intensity detection means calculates the average value of said maximum peak value and said next peak value and generates an output signal representing said average value; and wherein said intensity change detection means calculates the ratio of the maximum peak value to said next peak value and generates an output signal representative of said ratio.

4. An apparatus according to claim 3 wherein said peak detection means includes means for detecting pitch data from the leading edge of said input signal.

5. An apparatus according to claim 1 wherein said musical tone generation control means controls: tone volume of said musical tone in accordance with the detected signal intensity; and the timbre of the musical tone in accordance with the detected signal intensity changes.

6. An electronic musical instrument for extracting pitch data from an input signal, the amplitude of which changes cyclically to generate a musical tone having a corresponding tone pitch, comprising:

pitch extraction means for extracting the pitch from the input signal in accordance with a period of said input signal;

intensity detection means for detecting signal intensity at the leading edge of said input signal;

intensity change detection means for detecting changes of signal intensities at the leading edge of the input signal; and musical tone generation control means for controlling a first parameter of a musical tone to be generated in accordance with the detected signal intensity and for controlling a second parameter of the musical tone to be generated in accordance with the detected change in signal intensity and controlling tone pitch of the musical tone to be generated in accordance with the pitch data obtained by said pitch extraction means.

7. An instrument according to claim 6, further comprising peak detection means for detecting a maximum peak value of said input signal and the next peak value having the same sign as that of the maximum peak value, and wherein said intensity detection means calculates the average value of the maximum peak value and said next peak value to obtain an average signal intensity value.

8. An instrument according to claim 7, wherein said peak detection means includes means for detecting pitch data from the leading edge of said input signal.

9. An instrument according to claim 7, wherein said intensity change detection means calculates the ratio of the maximum peak value to said next peak value to obtain the change in signal intensity.

10. An instrument according to claim 7, wherein said intensity change detection means calculates the difference between the maximum peak value and the next peak value to obtain the change in signal intensity.

11. An instrument according to claim 6, further comprising peak detection means for detecting the maximum path value of said input signal and the next peak value having the same sign as that of the maximum peak value, and wherein said intensity detection means calculates signal intensity on the basis of the detected maximum peak value, and said intensity change detection means calculates the change in signal intensity on the basis of at least the values of said maximum peak value and said next peak value.

12. An instrument according to claim 11, wherein said intensity change detection means calculates the ratio of the maximum peak values to the next peak value to obtain the change in signal intensity.

13. An instrument according to claim 11, wherein said intensity change detection means includes means for calculating the difference between the maximum peak value and the next peak value to obtain the change in signal intensity.

14. An instrument according to claim 6, wherein said electronic musical instrument is an electronic stringed instrument having a plurality of metal strings, pickup means arranged for each of said plurality of metal strings, and wherein said input signal is supplied from said pickup means.

* * * * *